US011045740B2

(12) United States Patent
Wang

(10) Patent No.: US 11,045,740 B2
(45) Date of Patent: Jun. 29, 2021

(54) RACE TRACK TOY SET

(71) Applicant: Laltitude LLC, Hacienda Heights, CA (US)

(72) Inventor: Howard Wang, Hacienda Heights, CA (US)

( * ) Notice: Subject to any disclaimer, the term of this patent is extended or adjusted under 35 U.S.C. 154(b) by 0 days.

(21) Appl. No.: 16/827,350

(22) Filed: Mar. 23, 2020

(65) Prior Publication Data

US 2020/0360827 A1 Nov. 19, 2020

(51) Int. Cl.
*A63H 33/26* (2006.01)
*A63H 18/02* (2006.01)

(52) U.S. Cl.
CPC ..... *A63H 18/02* (2013.01); *A63H 33/26* (2013.01)

(58) Field of Classification Search
CPC ..... A63H 18/02–06; A63H 33/26
USPC ..... 446/444–447, 137; D21/565; 238/10 A–10 F
See application file for complete search history.

(56) References Cited

U.S. PATENT DOCUMENTS 1,599,699 A * 9/1926 Zabel ..... A63H 18/028 104/55
1,886,484 A * 11/1932 Kline ..... A63H 18/12 104/305
2,690,626 A * 10/1954 Gay ..... A63H 18/10 446/130
3,502,332 A * 3/1970 Wolf ..... A63H 18/00 463/69
3,572,713 A * 3/1971 Krause ..... A63H 18/02 463/69
3,581,987 A * 6/1971 Tomaro ..... A63H 21/04 238/10 E
4,147,351 A * 4/1979 Saito ..... A63H 18/08 446/441
4,151,679 A * 5/1979 Tanaka ..... A63H 18/08 446/445
4,154,019 A * 5/1979 Neuhierl ..... A63H 18/02 446/129
4,455,783 A * 6/1984 Nagano ..... A63H 19/04 446/71
4,504,243 A * 3/1985 Barlow ..... A63F 3/00634 446/444
4,838,828 A * 6/1989 Ohnuma ..... A63H 18/02 238/10 F
4,941,611 A * 7/1990 Arsenault ..... A63F 3/00634 238/10 A (Continued)

*Primary Examiner* — Eugene L Kim
*Assistant Examiner* — Matthew B Stanczak
(74) *Attorney, Agent, or Firm* — Clement Cheng

(57) ABSTRACT

A magnetic block track provided as a set has track blocks provided as a set of track blocks selected from at least one of the following of the group of: basic blocks; straight road section blocks; and curved section blocks. The track blocks are generally planar with a top side, a bottom side, and a sidewall with a sidewall height that is less than a length of the track blocks. A pair of permanent magnets is mounted within sidewalls of the track blocks. The pair of permanent magnets are aligned to attract to each other. A first slot is formed on the track blocks starting at slot funnel formed on the sidewall. The first slot is formed between the pair of permanent magnets. A toy vehicle has a pair of protruding vehicle guides configured to engage the first slot.

10 Claims, 34 Drawing Sheets

(56) References Cited

U.S. PATENT DOCUMENTS 4,953,786 A * 9/1990 Arsenault ..... A63F 3/00634 238/10 B
5,232,154 A * 8/1993 Jenkins ..... E01B 23/02 104/62
5,456,410 A * 10/1995 Chow ..... A63H 18/02 104/125
D382,026 S * 8/1997 Petersson ..... D21/565
D388,138 S * 12/1997 Lanoix ..... D21/565
5,704,822 A * 1/1998 Nilsson ..... A63H 19/32 104/130.01
5,826,835 A * 10/1998 Wilson ..... A63H 19/30 246/415 A
5,924,907 A * 7/1999 Tobin ..... A63F 7/386 446/168
6,009,812 A * 1/2000 Ernst ..... A63H 18/00 104/124
6,062,942 A * 5/2000 Ogihara ..... A63H 18/025 246/415 A
6,093,079 A * 7/2000 House ..... A63H 18/02 238/10 E
6,427,926 B1 * 8/2002 Lai ..... A63H 18/02 104/53
6,431,936 B1 * 8/2002 Kiribuchi ..... A63H 33/046 446/129
6,439,955 B1 * 8/2002 Feketo ..... A63H 17/00 446/121
D651,661 S * 1/2012 Yuen ..... D21/565
8,176,852 B2 * 5/2012 O'Connor ..... A63H 18/028 104/53
8,262,431 B2 * 9/2012 Nakano ..... A63H 18/02 446/446
8,282,438 B2 * 10/2012 Tamulewicz ..... A63H 33/26 446/129
D689,142 S * 9/2013 Mimlitch, III ..... D21/565
8,771,034 B2 * 7/2014 Mak Wing Kwong ..... A63H 18/08 446/441
9,314,707 B2 * 4/2016 Ornstein ..... A63H 33/046
9,364,769 B2 * 6/2016 Kosmo ..... A63H 33/086
9,713,777 B2 * 7/2017 Peterson ..... B29C 65/56
10,258,896 B2 * 4/2019 Ornstein ..... A63H 33/046
10,265,634 B2 * 4/2019 Daly ..... A63H 18/028
D884,802 S * 5/2020 Kelley ..... D21/491
10,758,834 B2 * 9/2020 Klein ..... A63H 33/42
10,857,475 B2 * 12/2020 Moskowitz ..... A63H 33/103
10,918,963 B2 * 2/2021 Ornstein ..... A63H 33/06
2003/0224697 A1 * 12/2003 Sheltman ..... A63H 18/00 446/444
2007/0057080 A1 * 3/2007 Ngai ..... A63H 18/04 238/10 F
2008/0265049 A1 * 10/2008 Stadlbauer ..... A63H 18/08 238/10 F
2010/0248586 A1 * 9/2010 Cochella ..... A63H 18/02 446/444
2010/0258646 A1 * 10/2010 Tamulewicz ..... A63H 18/02 238/10 B
2012/0052766 A1 * 3/2012 Payne ..... A63H 18/028 446/444
2012/0252310 A1 * 10/2012 Lin ..... A63H 33/26 446/138
2013/0126628 A1 * 5/2013 DiBartolo ..... A63H 18/02 238/10 A
2014/0206256 A1 * 7/2014 Chan ..... A63H 19/30 446/444
2014/0227934 A1 * 8/2014 Rudisill ..... A63H 33/046 446/92
2015/0367247 A1 * 12/2015 Kosmo ..... A63H 33/42 446/71
2016/0074762 A1 * 3/2016 Klein ..... A63H 33/42 446/174
2016/0184727 A1 * 6/2016 Ornstein ..... A63H 33/046 446/92
2016/0228783 A1 * 8/2016 Fiebig ..... A63H 19/30
2018/0104609 A1 * 4/2018 Musliner ..... A63H 18/021
2018/0304166 A1 * 10/2018 Tsai ..... A63H 17/36
2019/0255451 A1 * 8/2019 Paperno ..... A63H 33/16
2020/0360827 A1 * 11/2020 Wang ..... A63H 18/02

* cited by examiner

RACE TRACK TOY SET

The present invention claims priority from China design patent application 201930236302.2 filed on May 16, 2019 entitled Magnetic Magic Transportation by applicant Zhejiang Jiajiao Toys Co., Ltd., the disclosure of which is incorporated herein by reference.

The present invention claims priority from utility model patent application 201921804459.1 filed Oct. 25, 2019 entitled One Orbit Magnetic Building Block by applicant Zhejiang Jiajiao Toys Co., Ltd., the disclosure of which is incorporated herein by reference.

The present invention claims priority from China design patent application 201930590116.9 filed on Oct. 29, 2019 entitled Orbital Magnetic Building Blocks by applicant Zhejiang Jiajiao Toys Co., Ltd., the disclosure of which is incorporated herein by reference.

FIELD OF THE INVENTION

The present invention the field of magnetic toy tracks.

DISCUSSION OF RELATED ART

Building block toys are some of the best early childhood education toys for children, especially track blocks. However, the traditional track blocks are generally made of wood and are hard-coated, which often makes them inconvenient and uninteresting in use.

SUMMARY OF THE INVENTION

A magnetic block track provided as a set has track blocks provided as a set of track blocks selected from at least one of the following of the group of: basic blocks; straight road section blocks; and curved section blocks. The track blocks are generally planar with a top side, a bottom side, and a sidewall with a sidewall height that is less than a length of the track blocks. A pair of permanent magnets is mounted within sidewalls of the track blocks. The pair of permanent magnets are aligned to attract to each other. A first slot is formed on the track blocks starting at slot funnel formed on the sidewall. The first slot is formed between the pair of permanent magnets. A toy vehicle has a pair of protruding vehicle guides configured to engage the first slot.

The basic blocks have a second slot crossing the first slot. Bridge section blocks have a first slot with a having hump shaped curve. Ramp section blocks connect track blocks from a lower level with a higher level. The pair of permanent magnets are arranged with an orientation. The width of the slot matches a height of the sidewall so that the slot can receive the sidewall in interference fit. The column bracket elevates the track blocks and connects two track blocks on an upper plane. The column bracket has retaining pillars that engage to cover socket openings formed at the vertices of the track blocks.

The column bracket has columns with a bracket pillar at an upper end of the column bracket, and a socket at a lower end of the column bracket. Multiple levels of column brackets can be stacked with bracket pillars extending into the socket. Four holes are located at each of the four vertices of the basic blocks, straight road section blocks, and curved section blocks.

The Y shaped track block has a switch. The Y shaped track block has a Y shaped slot, where the switch is mounted in the Y shaped slot. The T shaped track block has three switches.

The T shaped track block has a T shaped slot. The three switches are mounted in the T shaped slot.

The track blocks are made of plastic and have a block bottom with a block bottom frame having a bottom frame rib that extends along a bottom frame flat area, and a block cover joined to and fitting over the block bottom frame. The bottom frame rib forms a magnet retainer notch and bottom socket openings. The block cover forms the sidewalls that cooperate with the magnet retainer notch for retaining the magnets. The bottom frame rib forms magnet walls, namely bottom frame left magnet walls, bottom frame inside magnet walls, and bottom frame right magnet walls. The magnet walls form magnet retainer notches. The magnets are held within the magnet retainer notches.

Figure 1:
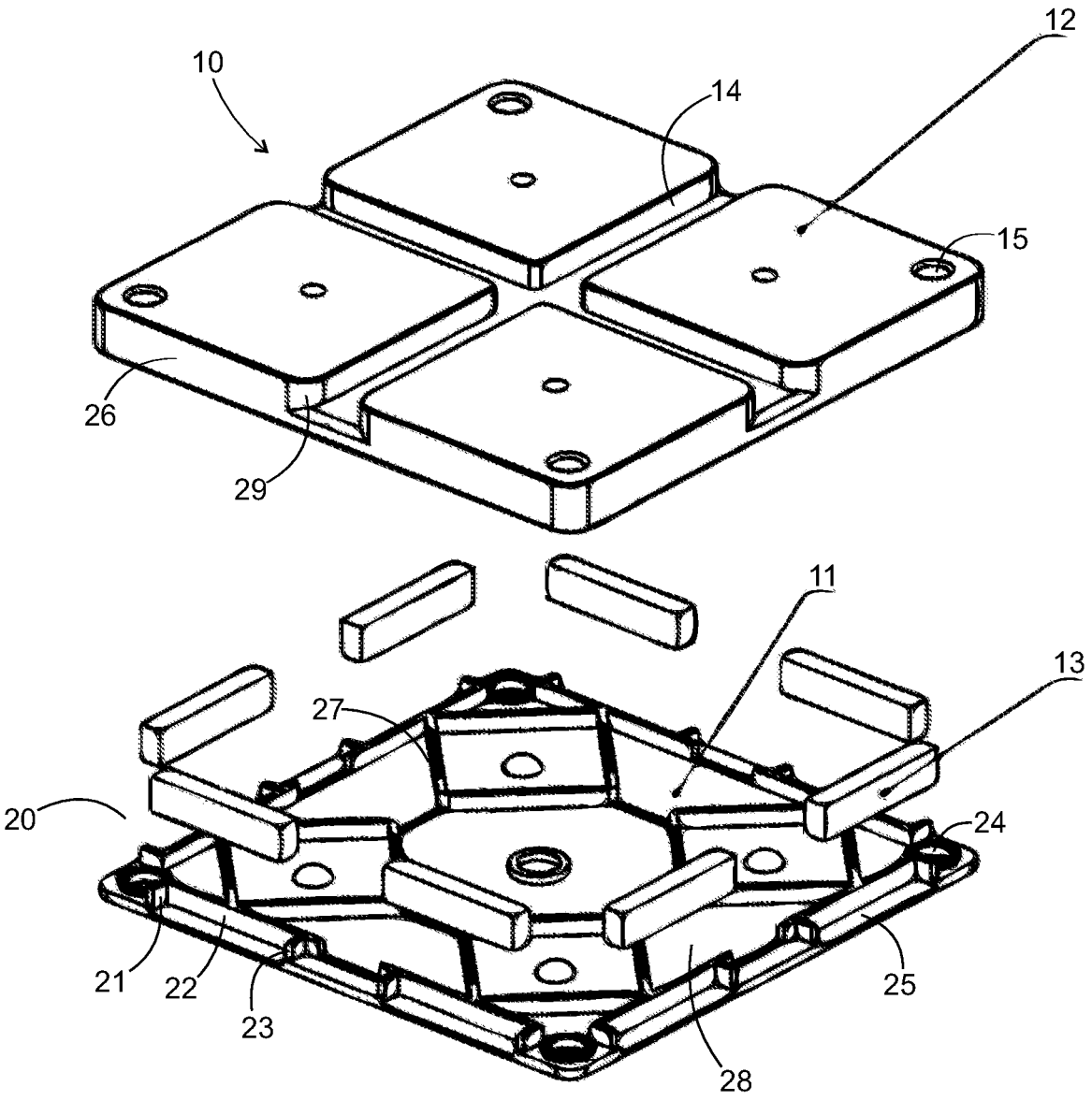
FIG. 1 is a perspective exploded schematic structural diagram of the block of the present invention showing assembly.

The following call out list of elements can be a useful guide for referencing the element numbers of the drawings.

A slot width
B sidewall height
10 block
11 block bottom
12 block cover
13 magnet
14 slot
15 cover socket opening
16 fork switch
17 first switch
18 second switch
19 third switch
20 block bottom frame
21 bottom frame left magnet wall
22 bottom frame inside magnet wall
23 bottom frame right magnet wall
24 bottom socket opening
25 magnet retainer notch
26 cover sidewall
27 bottom frame rib
28 bottom frame flat area
29 slot tunnel
30 bracket column
31 lower socket
41 entry opening
42 first exit opening
43 second exit opening
44 first entry opening
45 second entry opening
46 third entry opening
47 right entry slot sidewall
48 left entry slot sidewall
49 second entry opening right slot sidewall
50 second entry opening left slot sidewall
51 third entry opening first sidewall
52 third entry opening second sidewall
53 distal corner
60 basic block
61 raised section
62 straight road section block
63 curved section block
64 ramp section block
65 curved section block
66 bridge section
67 Junction track
68 Y shaped track
69 column bracket
101 upper plane
102 retaining pillars
102A first pillar
102B second pillar
102C third pillar
102D fourth pillar
103 bracket pillars
103A first bracket pillar
103B second bracket pillar
103C third bracket pillar
103D fourth bracket pillar
104 upper opening
104A first upper opening
104B second upper opening
104C third upper opening
104D fourth upper opening
105 lower opening
105A first lower opening
105B second lower opening
105C third lower opening
105D fourth lower opening
106 toy vehicle
108 vehicle guide
200 sign
201 upper end
202 lower end

DETAILED DESCRIPTION

As seen in FIG. 1, a block 10 includes a block bottom 11 and a block cover 12 fitting over the block bottom 11. The block 10 is preferably made of plastic injection molded members. The block bottom 11 has a block bottom frame 20 which comprises a bottom frame rib 27 that extends along a bottom frame flat area 28. The bottom frame rib 27 forms a magnet retainer notch 25 and bottom socket openings 24. A bottom frame left magnet wall 21, a bottom frame inside magnet wall 22, and a bottom frame right magnet wall 23 form magnet retaining walls of the magnet retainer notch 25. The magnets 13 are held within the magnet retainer notches 25. The block cover 12 has a cover socket opening 15 that communicates to the bottom socket opening 24. Each cover socket opening 15 in each corner of the block cover 12 provides an area for mounting. The block cover 12 includes a slot 14 with a slot funnel 29. The pair of slots 14 provides a track for a vehicle. The block cover 12 also has cover sidewalls 26. The cover sidewalls 26 cooperates with the magnet retainer notch 25 for retaining each magnet 13. The magnets 13 are sandwiched in pairs in between the block bottom 11 and the block cover 12.

Figure 2:
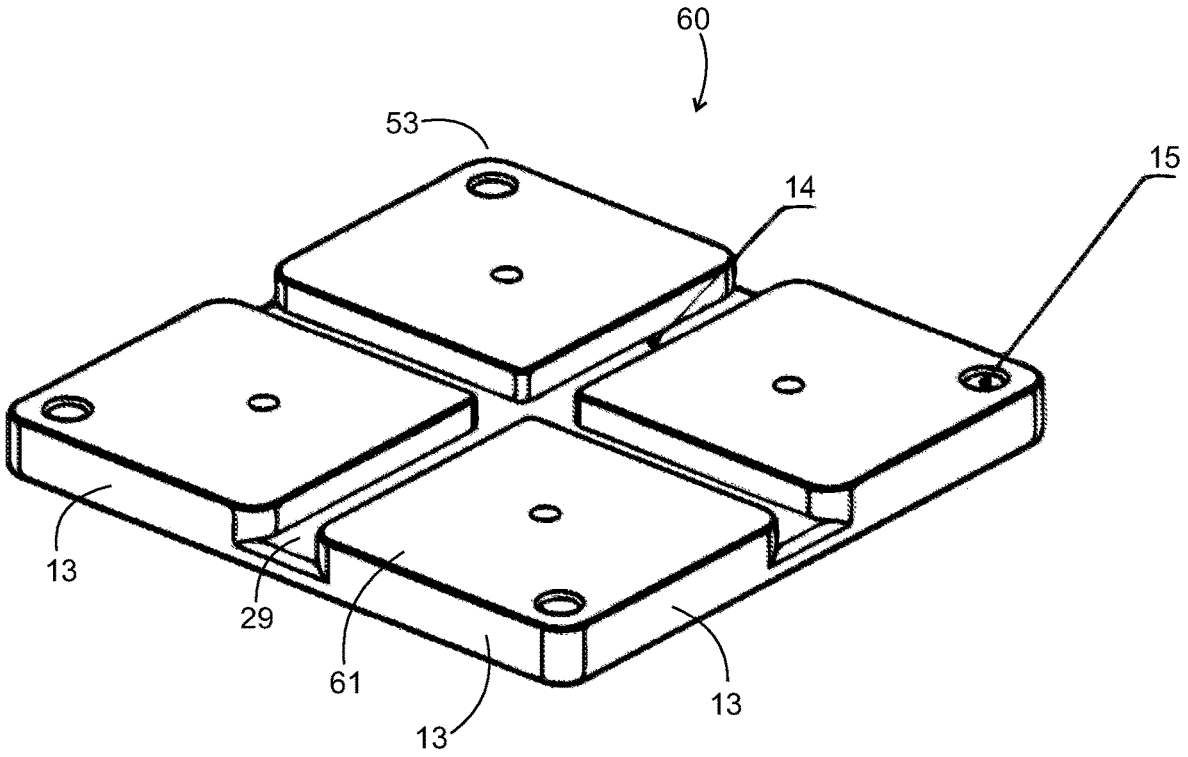
FIG. 2 is a perspective view of a block of the present invention.
Figure 25:
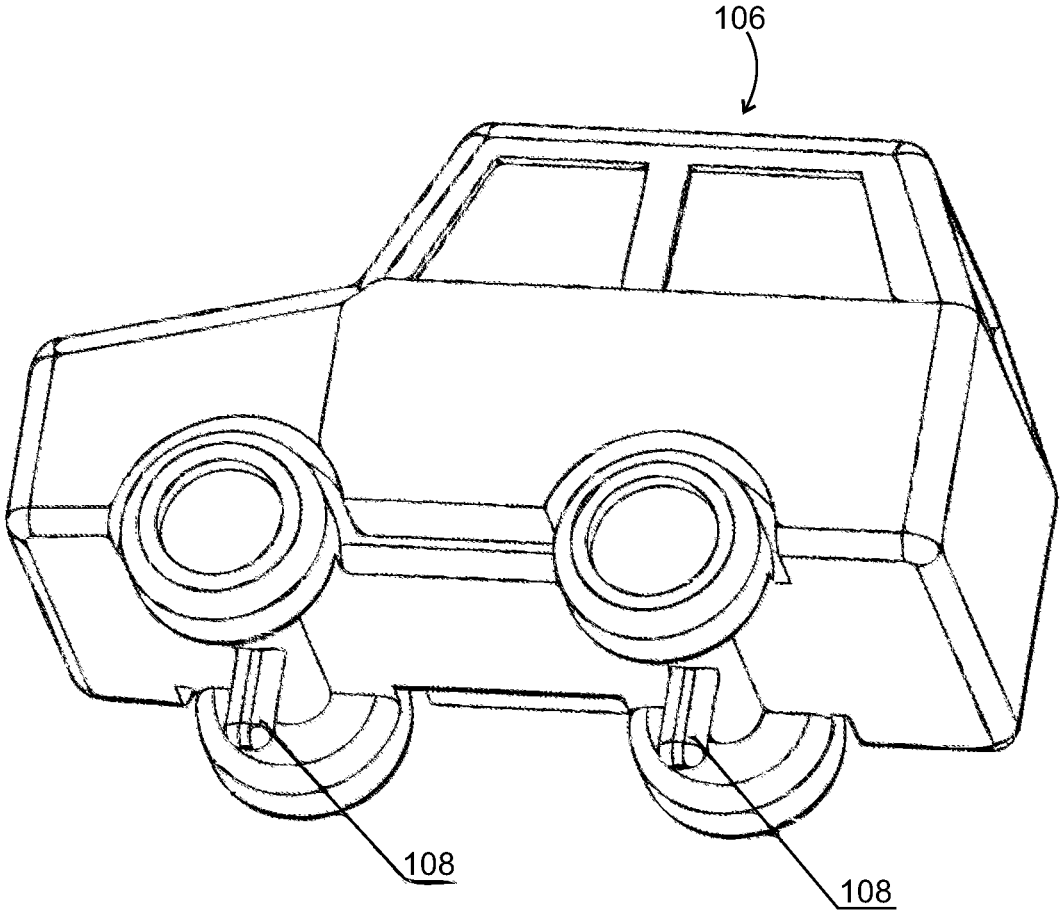
FIG. 25 is a schematic structural diagram of a bottom of an electric toy vehicle according to the present invention.
Figure 28:
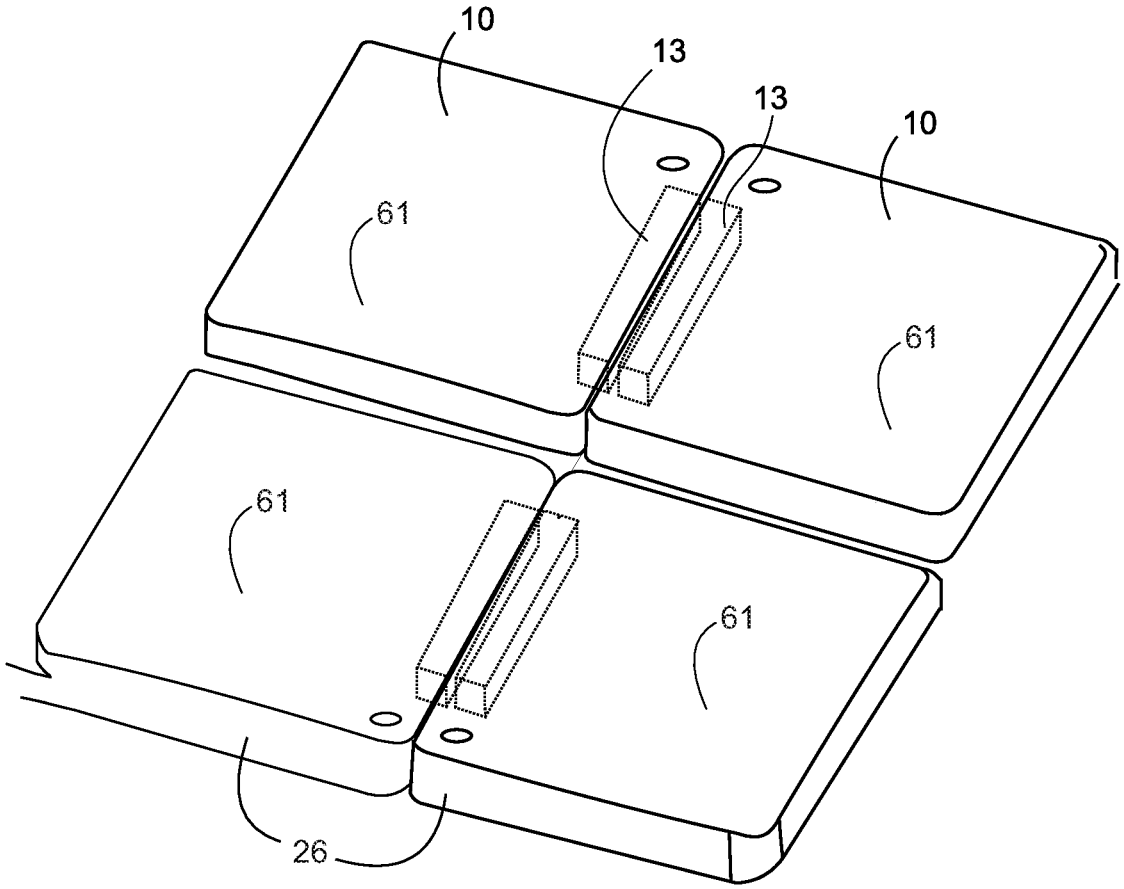
FIG. 28 is a schematic diagram of magnetic connection between the building blocks of the present invention.
Figure 31:
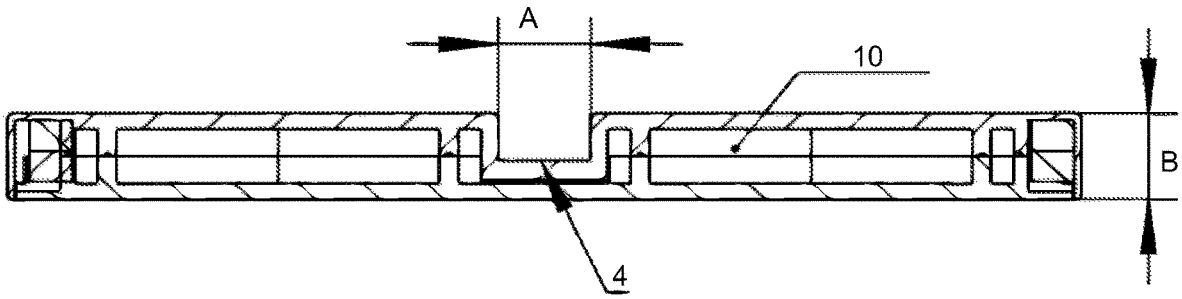
FIG. 31 is a cross sectional view of a block groove of a building block of the present invention.

The first building block, as shown in FIGS. 1 and 2, is composed of the building block bottom 11 and the building block cover 12 and the magnet 13. The magnet is a permanent magnet. The building block is provided with magnets 13 on each of the four sides. Four blocks having a normal angle, the magnets 13 have a polarity so that adjacent magnets from different blocks can be attracted to each other so as to automatically align the slots 14 with each other, as shown in FIG. 28. A cross-shaped slot 14 is formed on one surface of the block, as shown in FIG. 31. The width A of the slot 14 is configured with the thickness B of the building block so that an edge of the block can be inserted into the slot 14, as shown in FIG. 25. One hole is formed on each of the four vertices of the first block as a cover socket opening 15.

Figure 3:
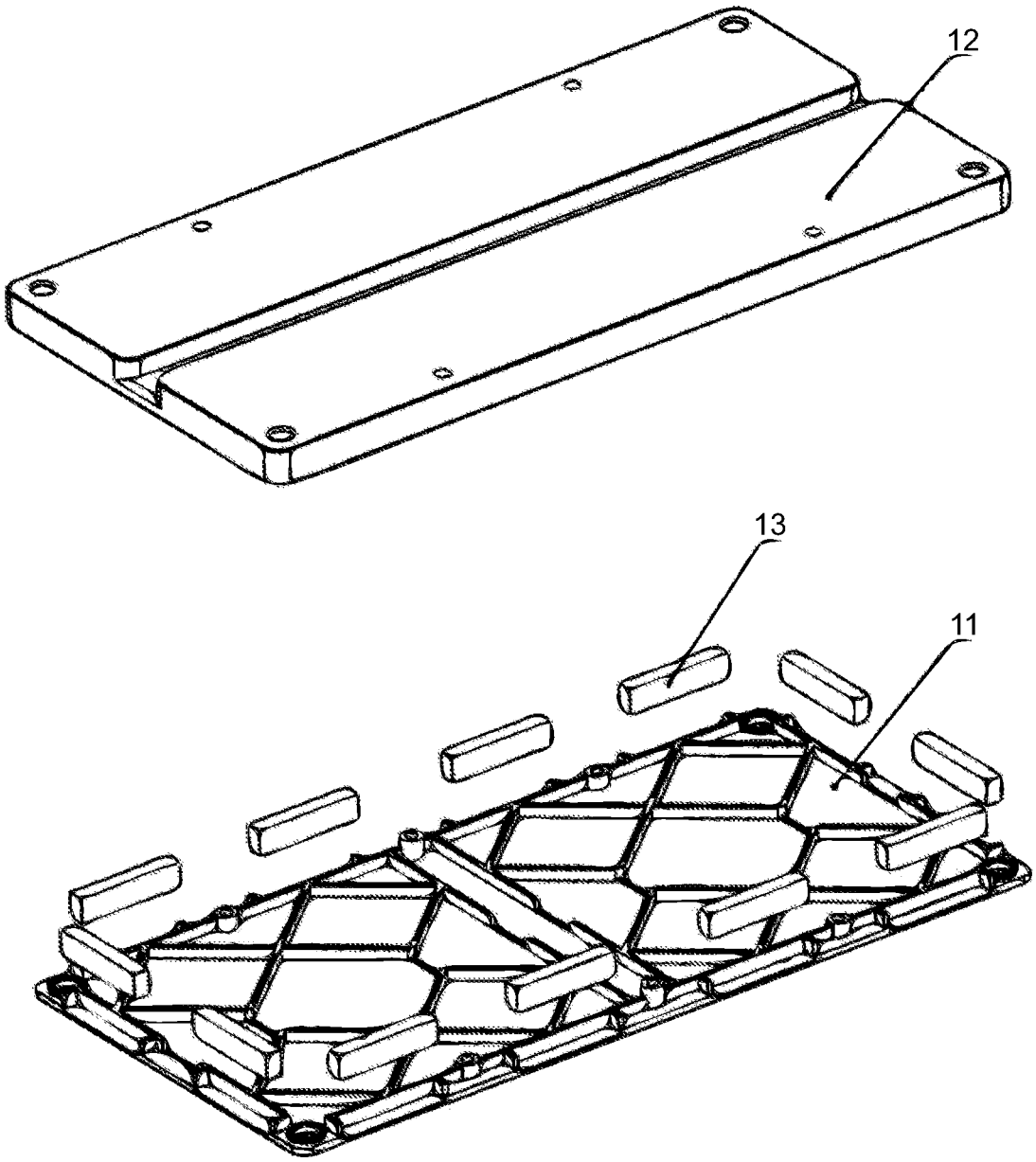
FIG. 3 is an exploded schematic structural diagram of a straight road section block of the present invention.
Figure 4:
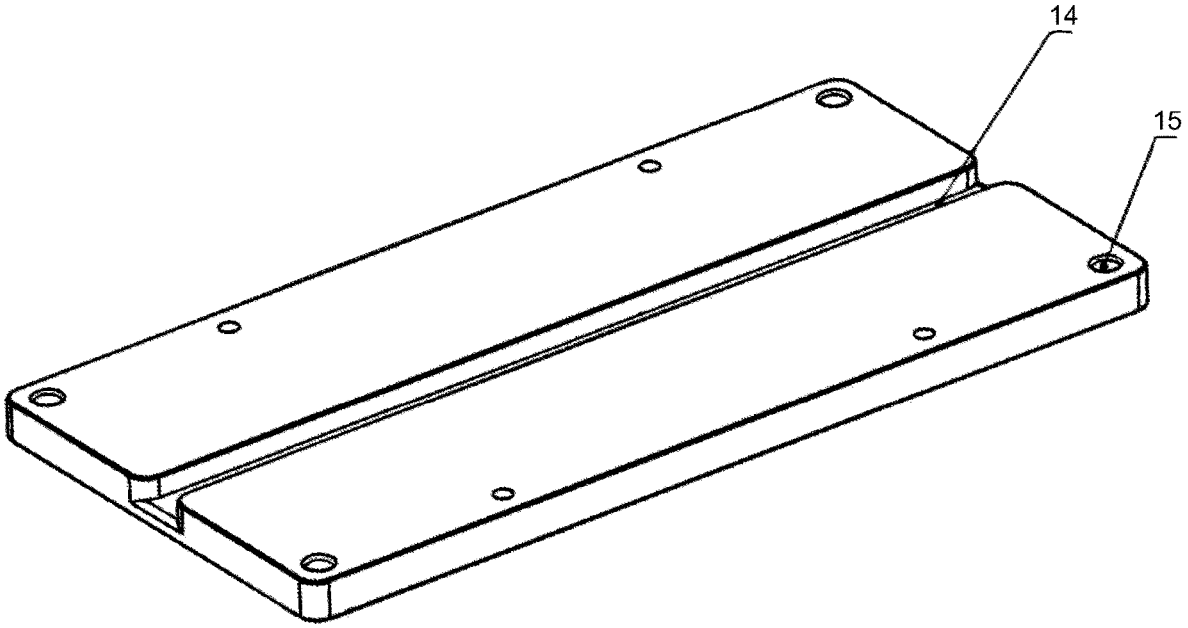
FIG. 4 is a perspective view of the straight road section block of the present invention.

As seen in FIGS. 2-4, the slot 14 is spaced apart from the socket 15. The basic block 60 has a single unit of measure and a pair of crossing slots. A pair of magnets are placed to the left and right of each slot funnel 29 for a total of eight bar shaped magnets. The basic block has 4 protruding square sections raised above the level of the crossing slots. Each protruding square section or raised section 61 has a distal corner 53 that contains a pair of magnets angled at a right angle to each other. The socket 15 provides a connection to vertical elements at each distal corner 53. Vertical elements may include signposts. The block cover 12 can be elongated for receiving multiple magnets within.

As seen in FIGS. 3-4, a straight road section block 62 is two units long and one unit wide and has a single slot traveling along its length. The second building block is a straight section of track, as shown in FIGS. 3 and 4, and is composed of building block bottom 11 and building block cover 12 and magnet 13. The magnet is also a permanent magnet, and two or four sides of the building block are provided with magnets 13. For blocks having a grid configuration of squares, the magnet 13 preferably has an orientation to provide automatic alignment of slots during assembly when magnets 13 are magnetically attracted to each other, as shown in FIG. 28.

Figure 5:
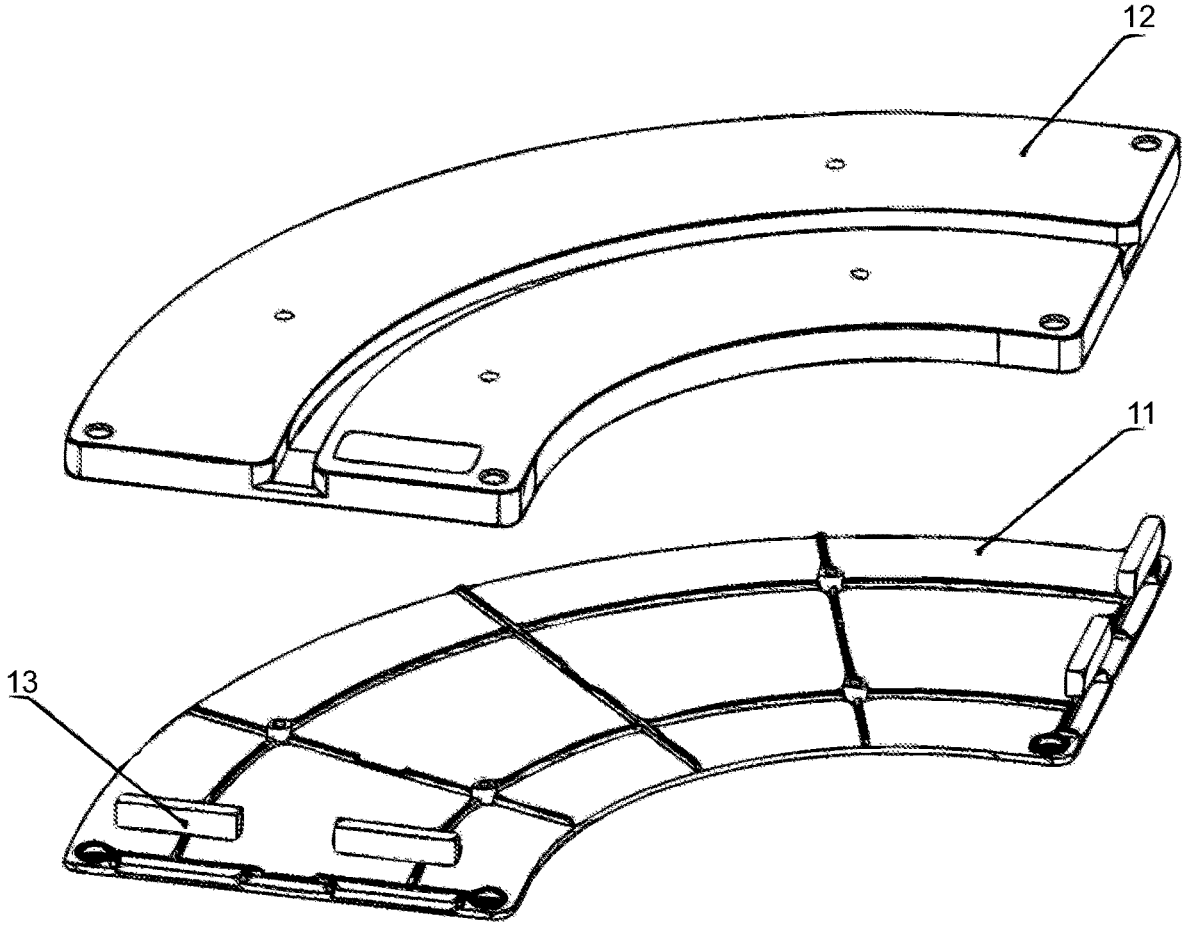
FIG. 5 is an exploded schematic structural diagram of the curved section block of the present invention.
Figure 6:
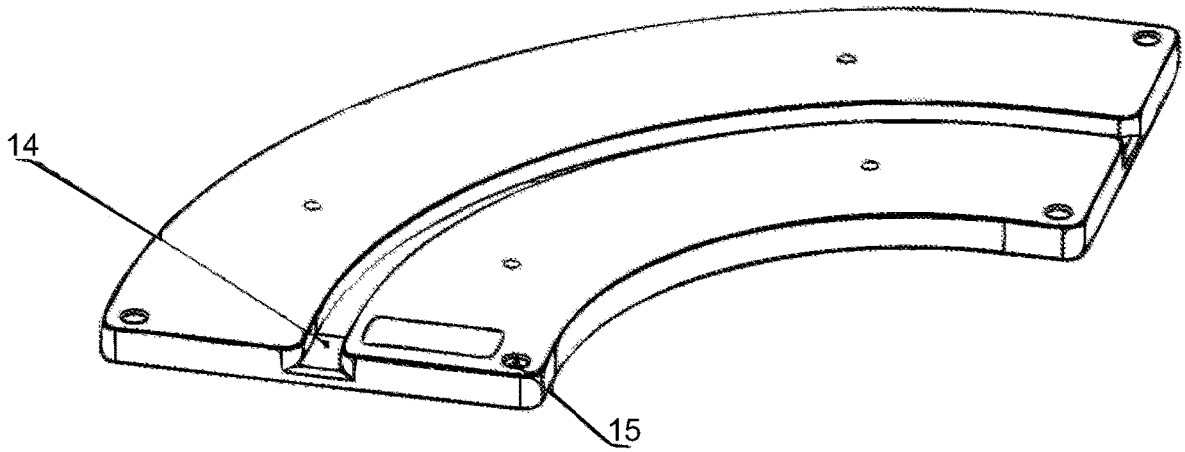
FIG. 6 is a perspective view of the curved section block of the present invention.

As seen in FIGS. 5-6, a curved section block 63 can be a curved track allows a 90° bend for changing track orientation. A hole 15 is one formed near each of the four vertices. The magnet is also a permanent magnet, and two or four sides of the building block are provided with magnets 13. For blocks having a grid configuration of squares, the magnet 13 preferably has an orientation to provide automatic alignment of slots during assembly when magnets 13 are magnetically attracted to each other.

Figure 7:
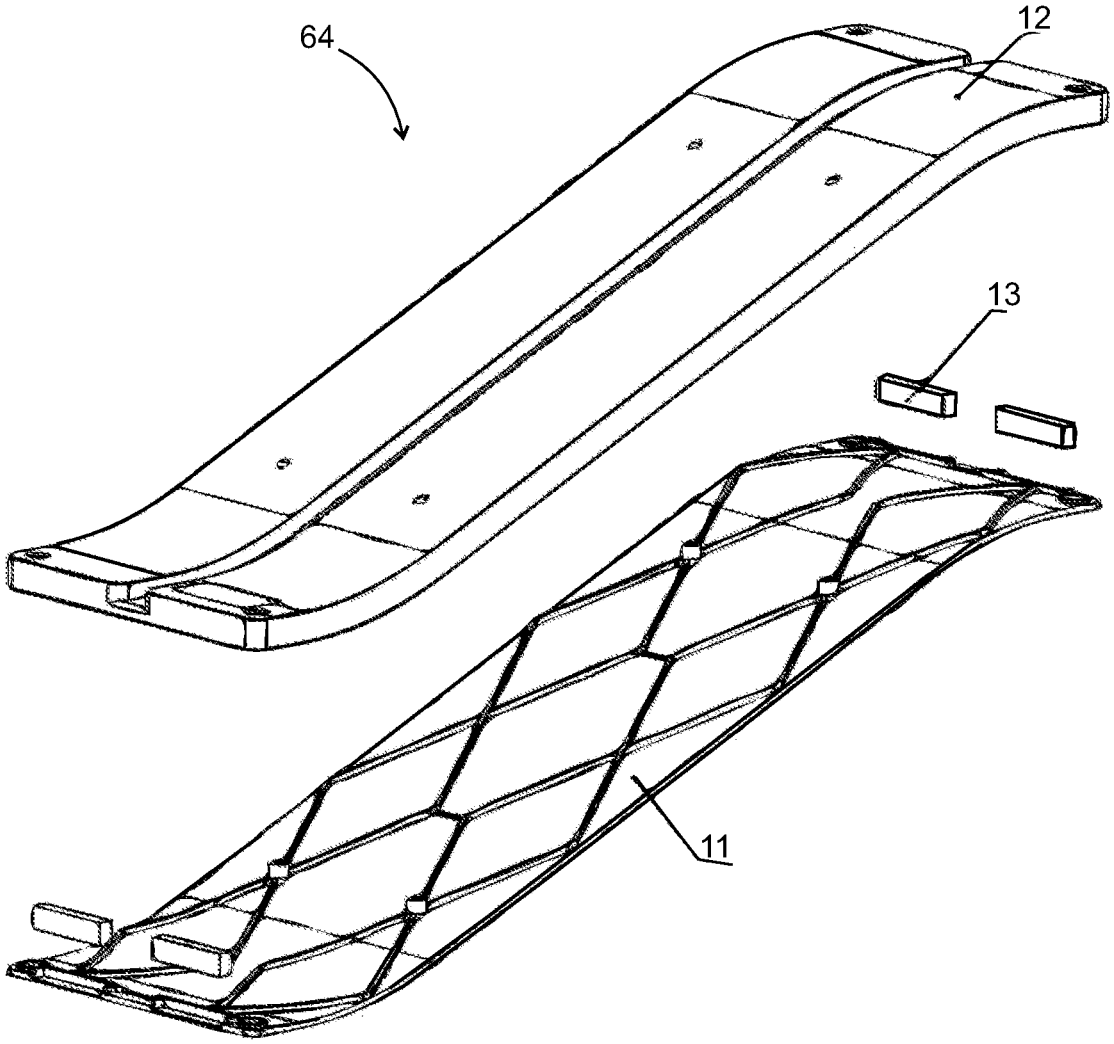
FIG. 7 is an exploded schematic structural diagram of the ramp section block of the present invention.
Figure 8:
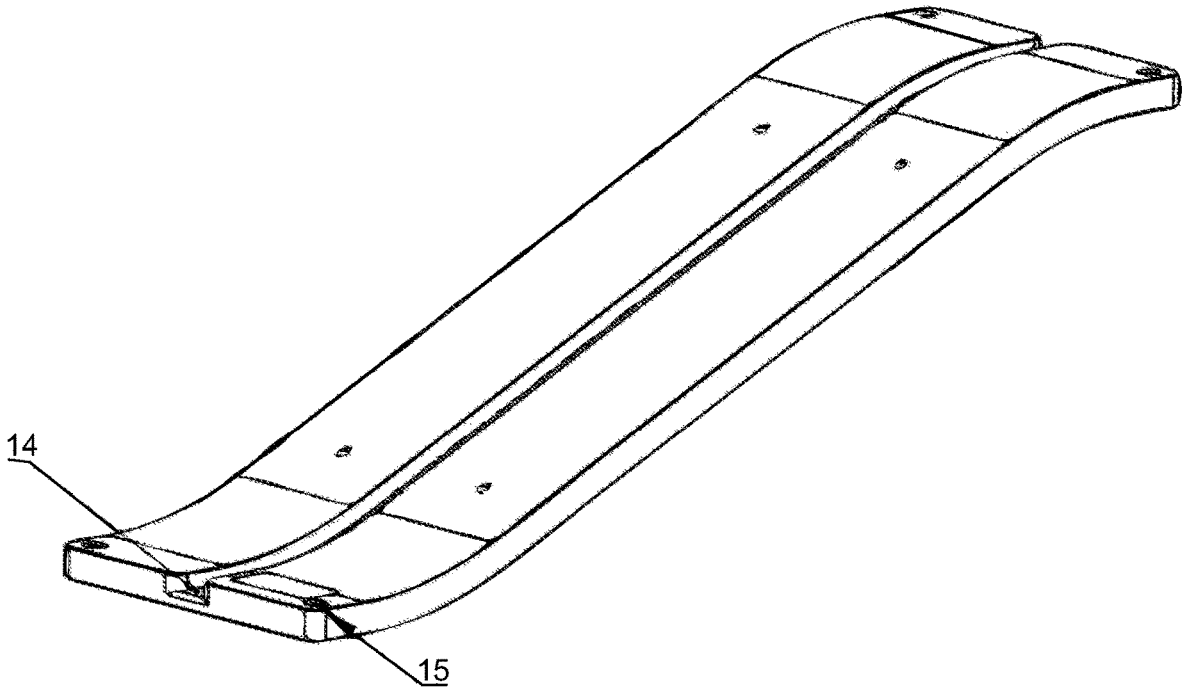
FIG. 8 is a perspective view of the ramp section block of the present invention.
Figure 9:
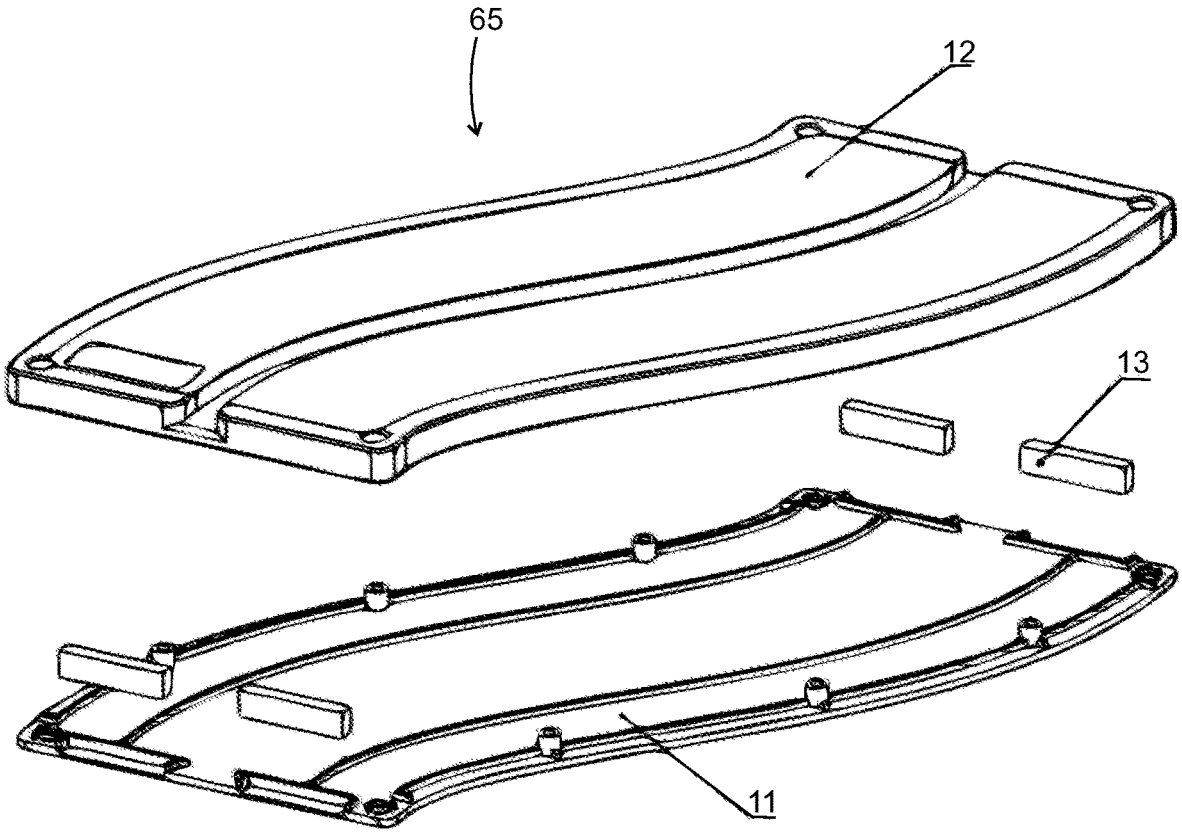
FIG. 9 is an exploded schematic structural diagram of a curved section block of the present invention.
Figure 10:
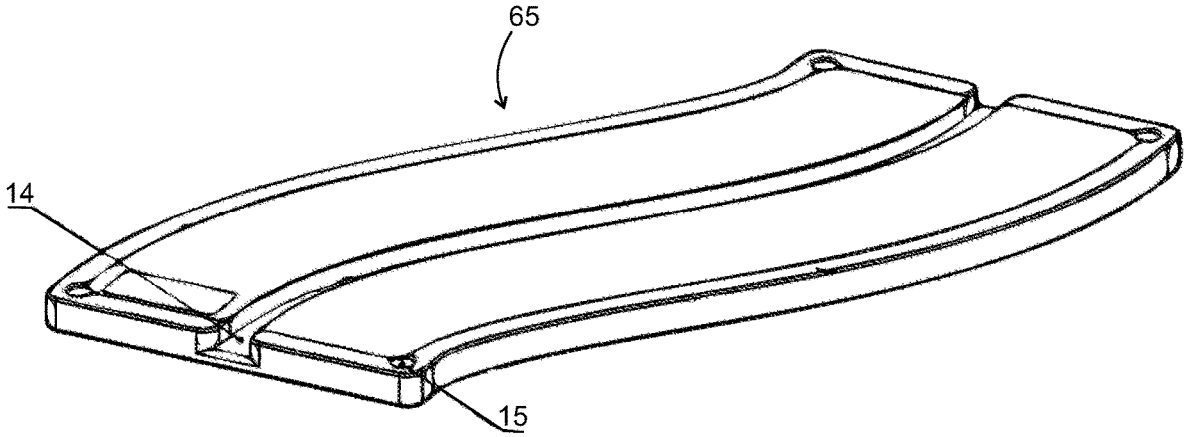
FIG. 10 is a perspective view of the curved section of the present invention.
Figure 11:
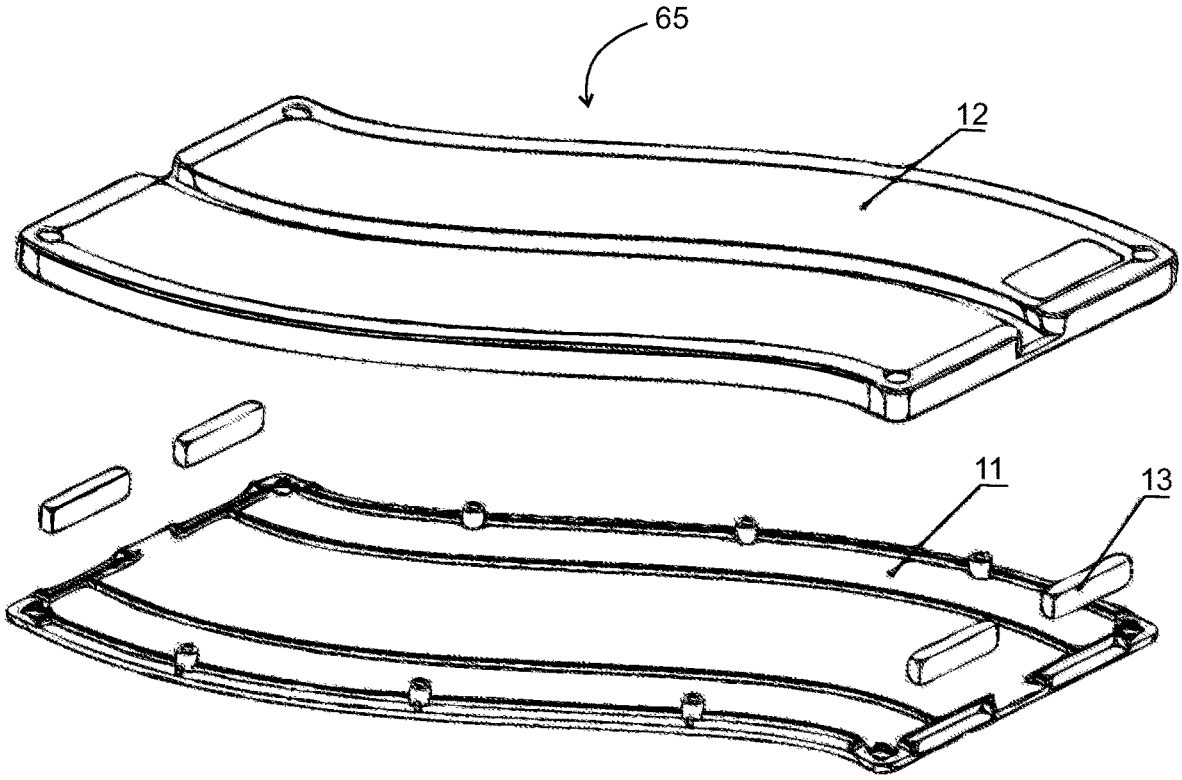
FIG. 11 is an exploded schematic structural diagram of a curved section block of the present invention.
Figure 12:
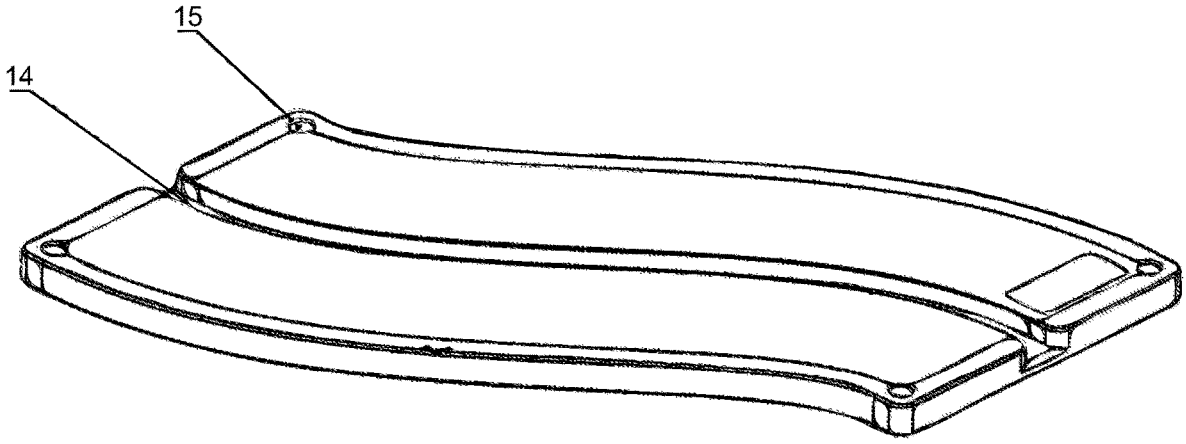
FIG. 12 is a perspective view of the curved section block of the present invention.

As seen in FIGS. 7-8, a ramp section block 64 can be a track provides a change in height to allow multiple levels of tracks. The slot has a ramp shape that conforms with the shape of the block. A hole 15 is one formed near each of the four vertices.

As seen in FIGS. 9-12, a curved section block 65 of track provides a shift in road placement. A hole 15 is one formed near each of the four vertices. The magnet is also a permanent magnet, and two or four sides of the building block are provided with magnets 13. For blocks having a grid configuration of squares, the magnet 13 preferably has an orientation to provide automatic alignment of slots during assembly when magnets 13 are magnetically attracted to each other.

Figure 13:
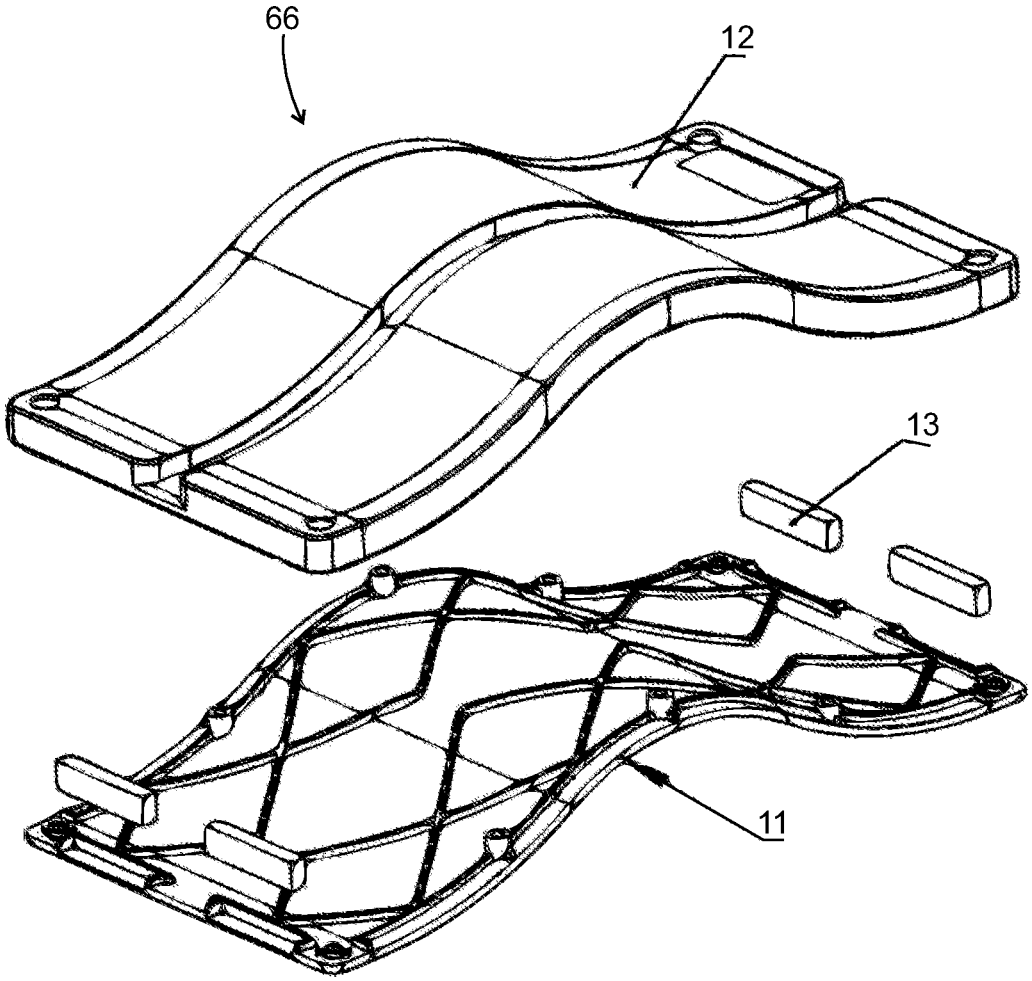
FIG. 13 is an exploded schematic structural diagram of a bridge section block of the present invention.
Figure 14:
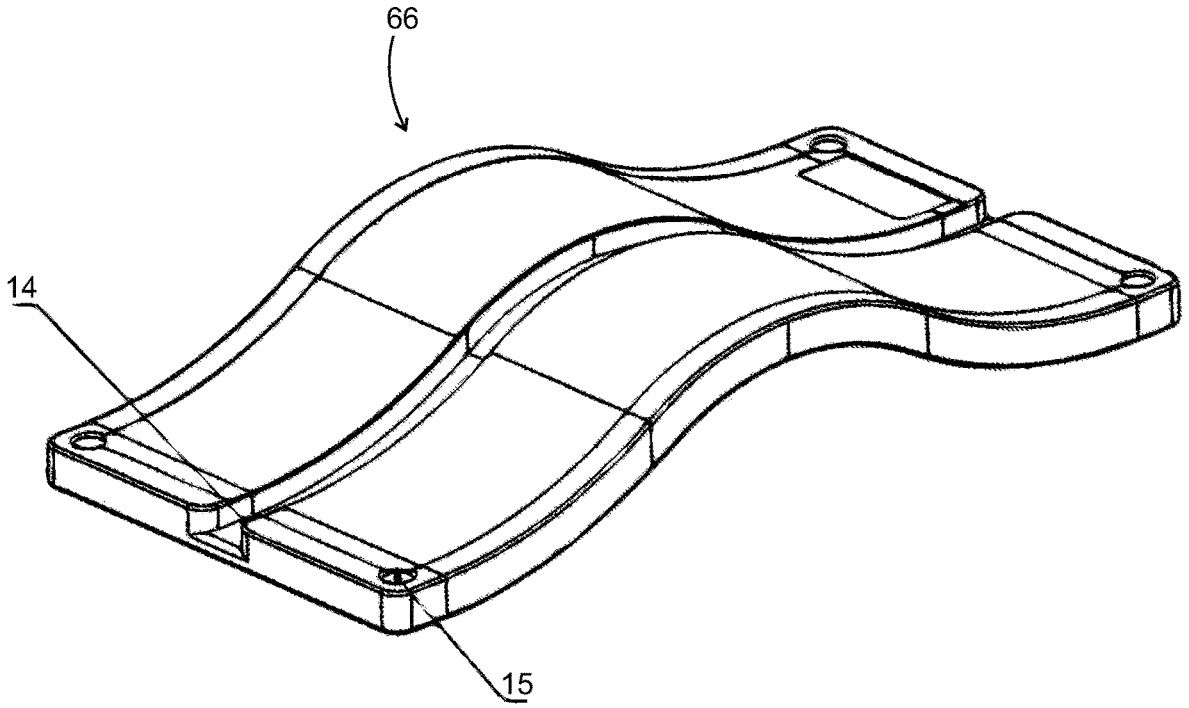
FIG. 14 is a perspective view of the bridge section block of the present invention.

As seen in FIGS. 13-14 a bridge section block 66 of track provides a protruded road. A hole 15 is one formed near each of the four vertices. The magnet is also a permanent magnet, and two or four sides of the building block are provided with magnets 13. For blocks having a grid configuration of squares, the magnet 13 preferably has an orientation to provide automatic alignment of slots during assembly when magnets 13 are magnetically attracted to each other.

Figure 15:
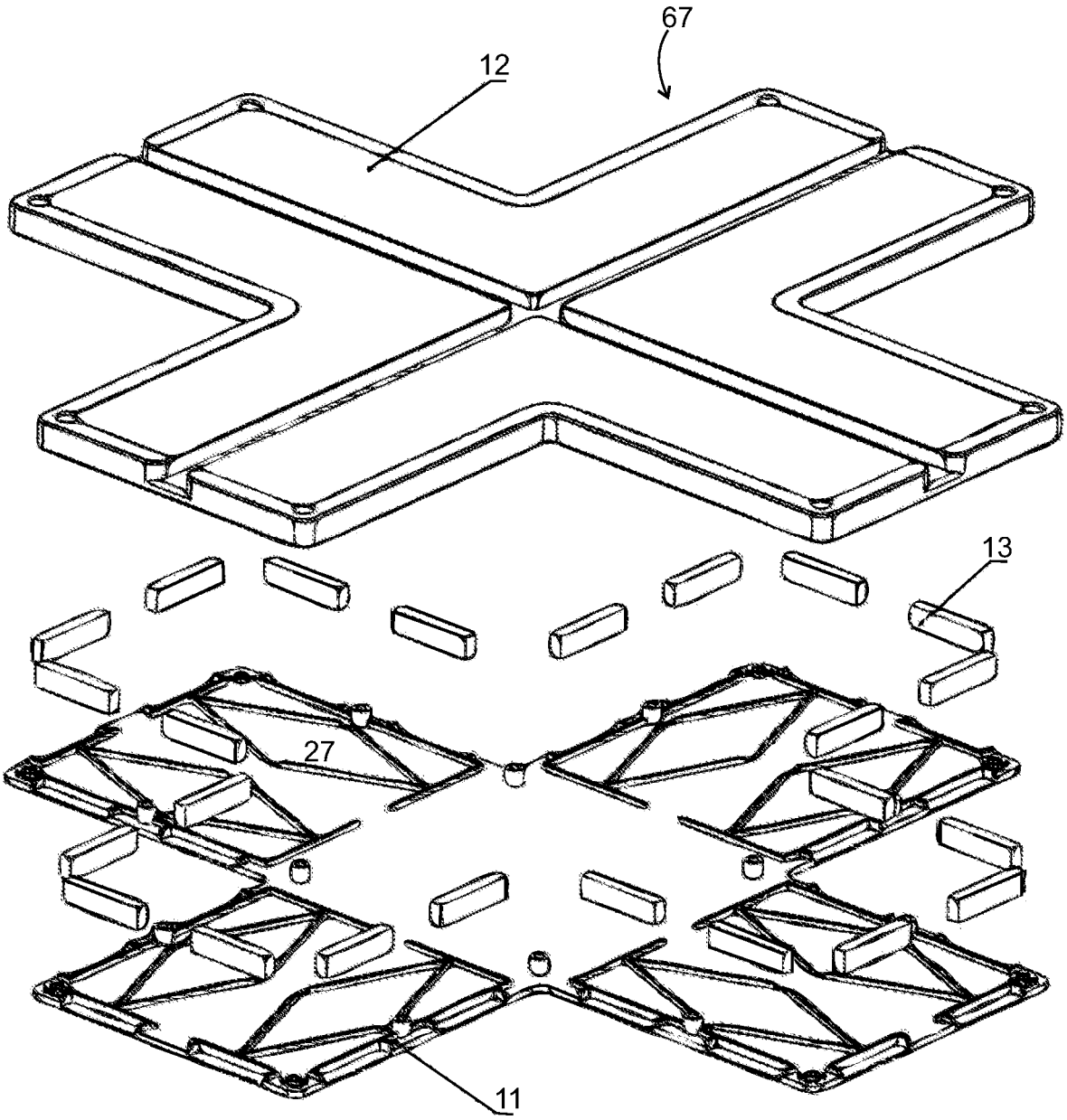
FIG. 15 is an exploded schematic structural diagram of a junction track block of the present invention.
Figure 16:
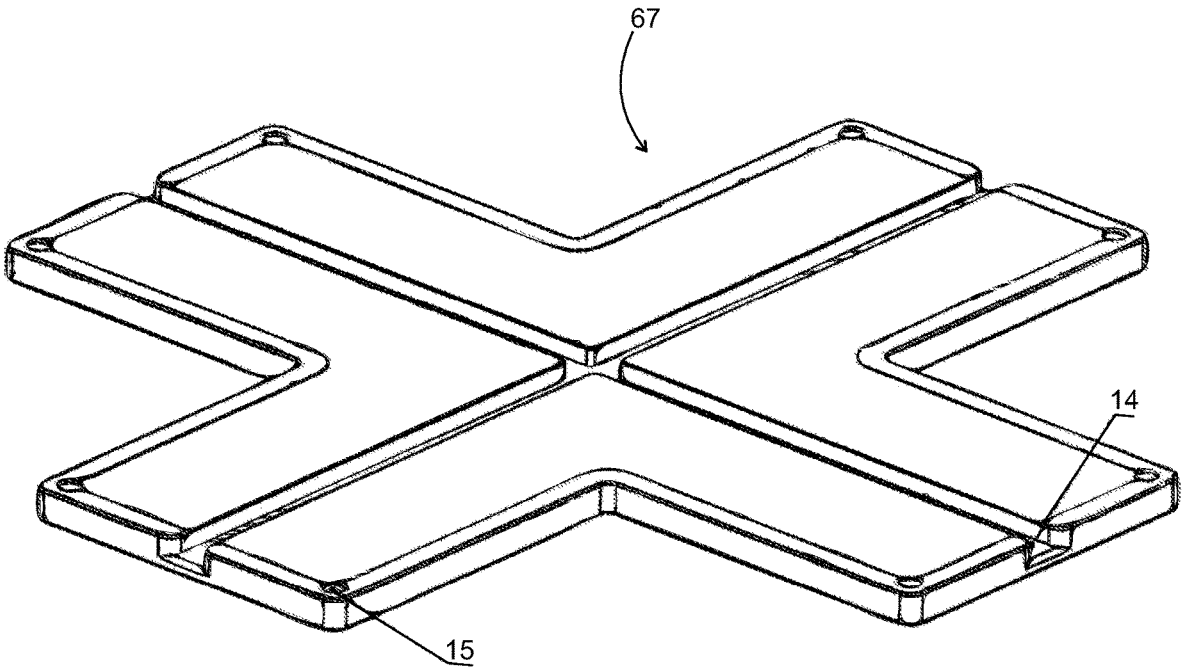
FIG. 16 is a perspective view of the junction track block of the present invention.

As seen in FIGS. 15-16 a junction track 67 provides a traffic intersection to connect roads. The junction track is three units long and three units wide. A hole 15 is one formed near each of the four vertices.

Figure 17:
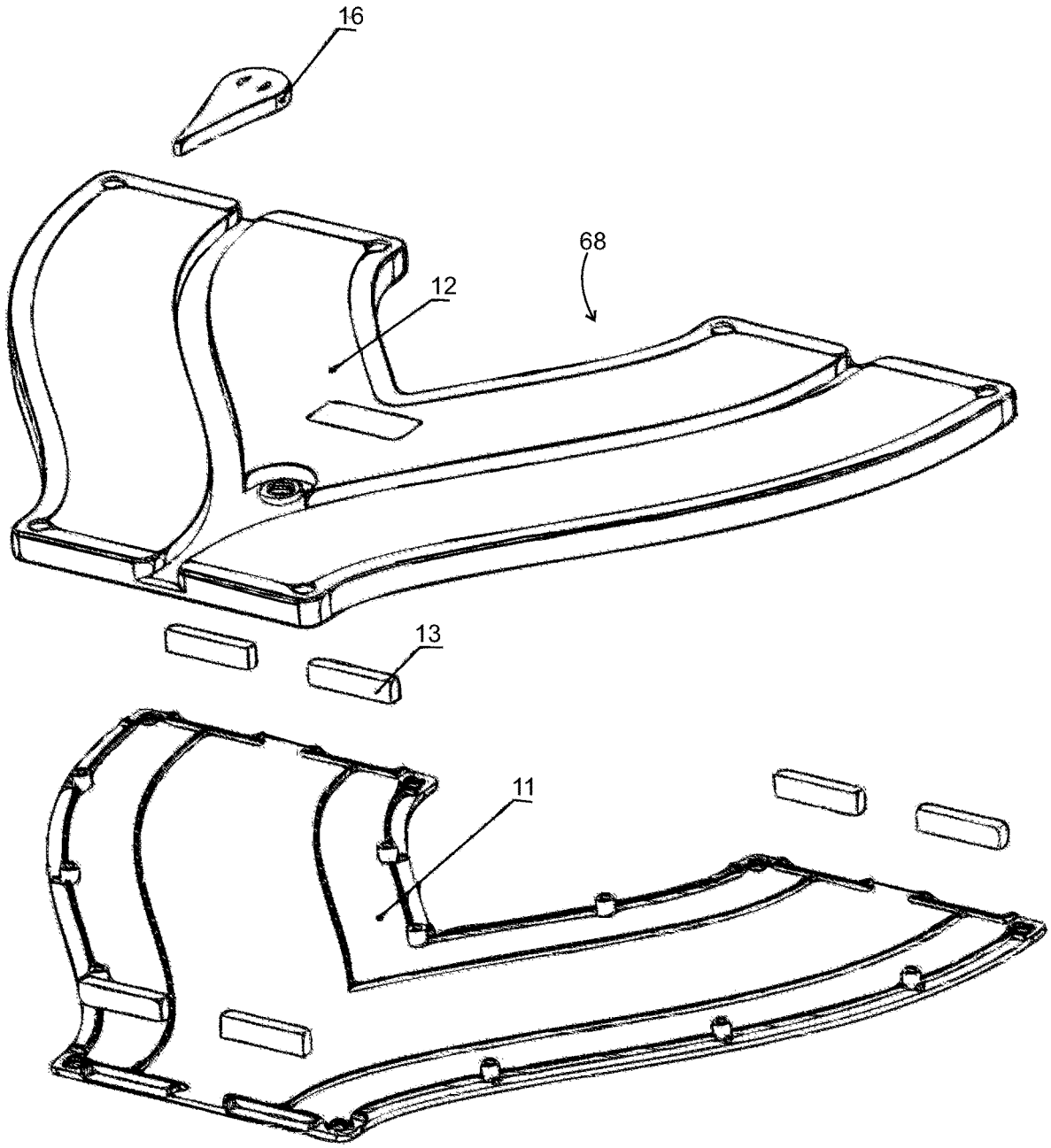
FIG. 17 is an exploded schematic structural diagram of the Y-shaped block of the present invention.
Figure 18:
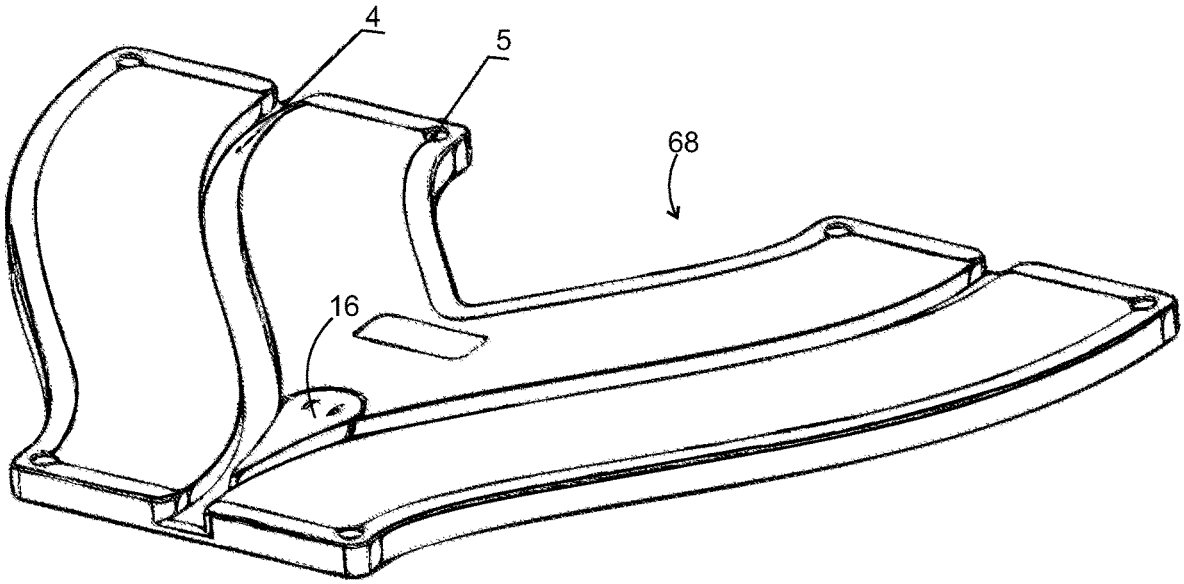
FIG. 18 is a perspective view of the Y-shaped block of the present invention.

As seen in FIGS. 17-18 a Y shaped track 68 provides a fork intersection to connect road sections. A hole 15 is one formed near each of the six vertices. The magnet is also a permanent magnet, and two or four sides of the building block are provided with magnets 13. For blocks having a grid configuration of squares, the magnet 13 preferably has an orientation to provide automatic alignment of slots during assembly when magnets 13 are magnetically attracted to each other.

Figure 19:
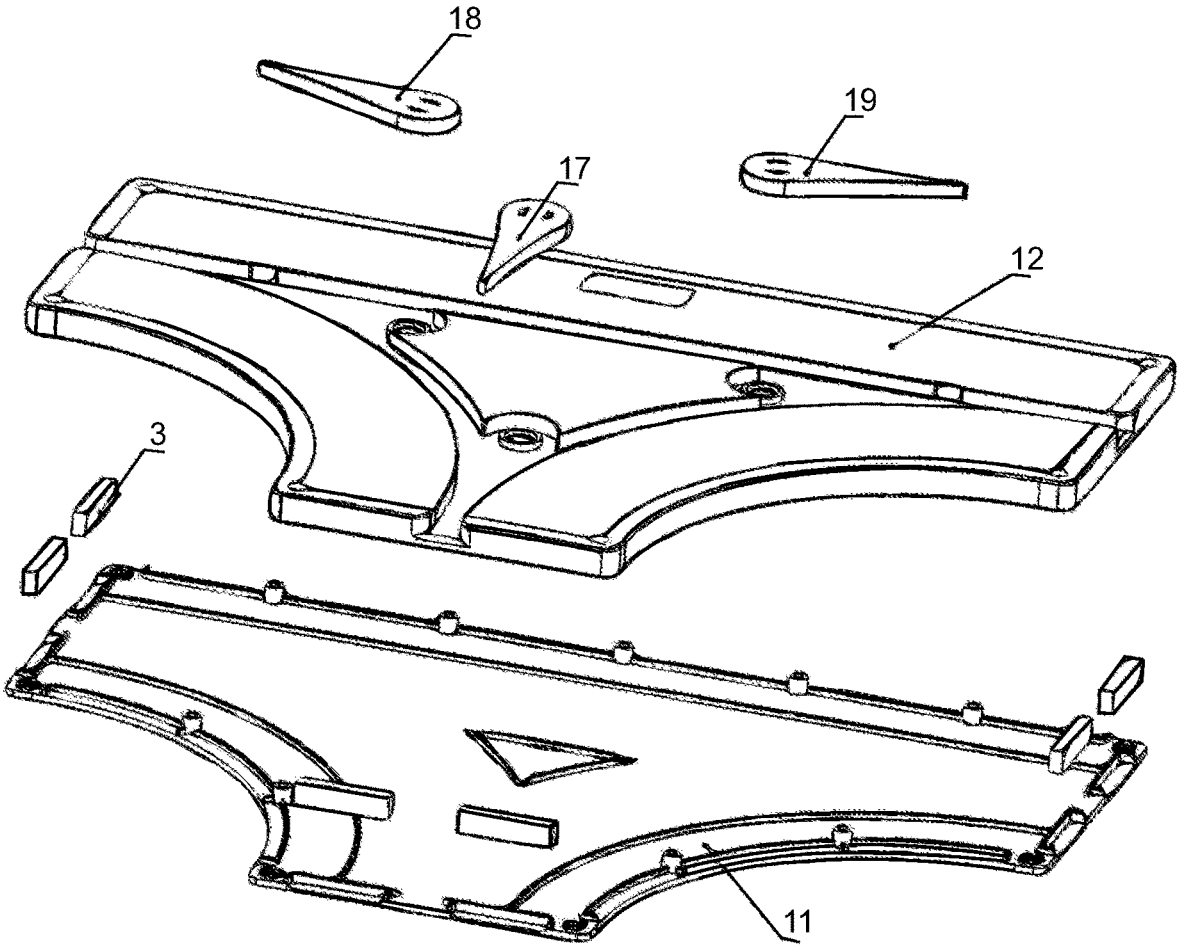
FIG. 19 is an exploded schematic structural diagram of a Y-shaped block of the present invention.
Figure 20:
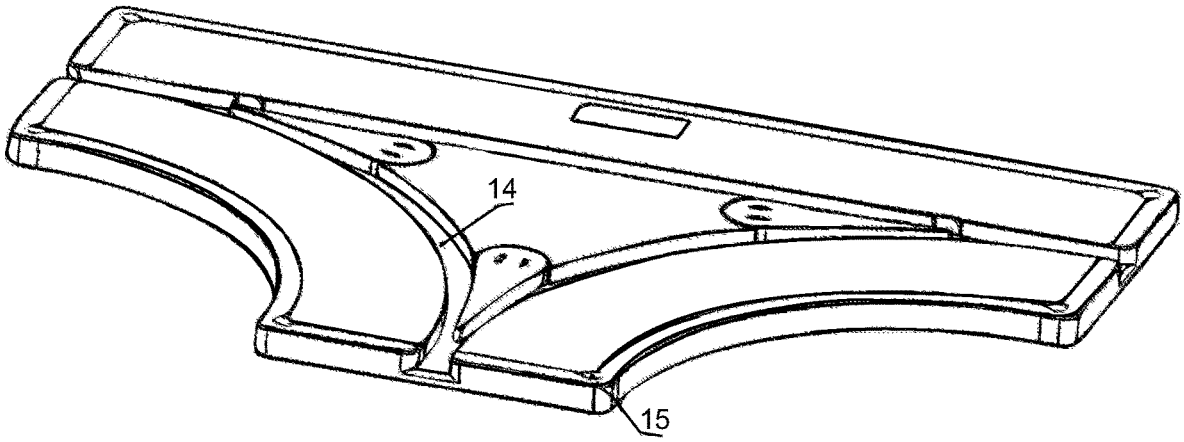
FIG. 20 is a perspective view of the Y-shaped block of the present invention.

As seen in FIGS. 19-20 a Y shaped track provides a fork intersection to connect road sections. The magnet is also a permanent magnet, and two or four sides of the building block are provided with magnets 13. For blocks having a grid configuration of squares, the magnet 13 preferably has an orientation to provide automatic alignment of slots during assembly when magnets 13 are magnetically attracted to each other.

Figure 21:
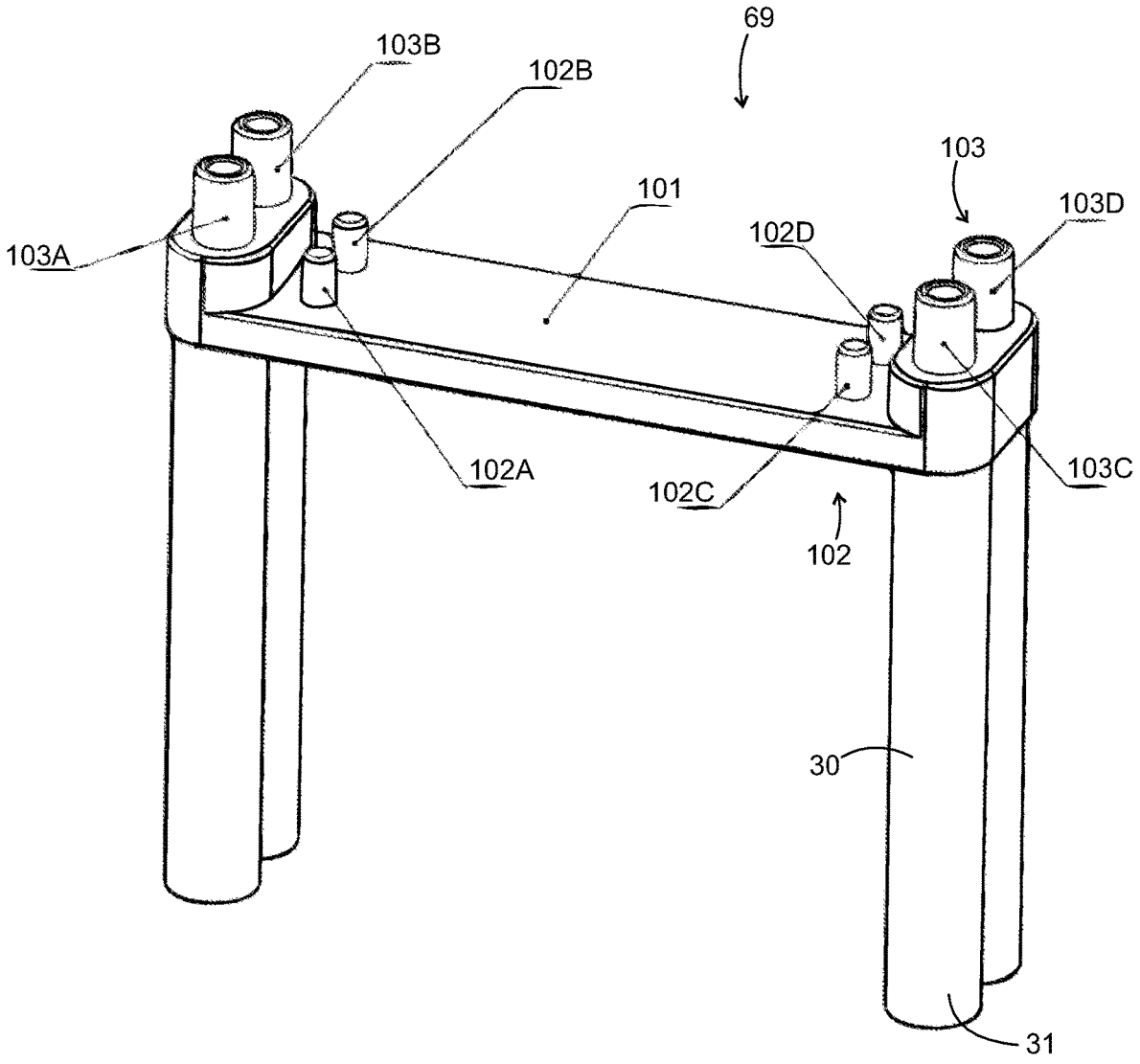
FIG. 21 is a perspective view of a column bracket of the present invention.
Figure 22:
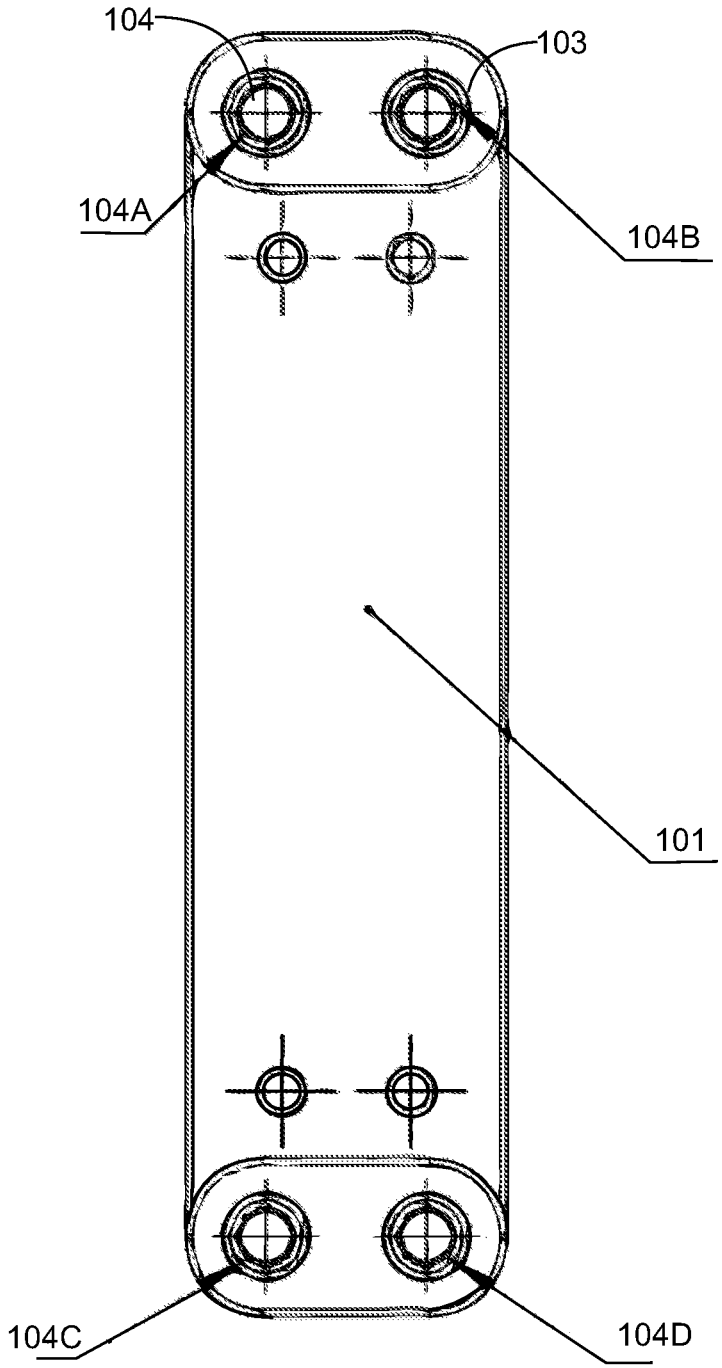
FIG. 22 is a top view of the column bracket of the present invention.
Figure 23:
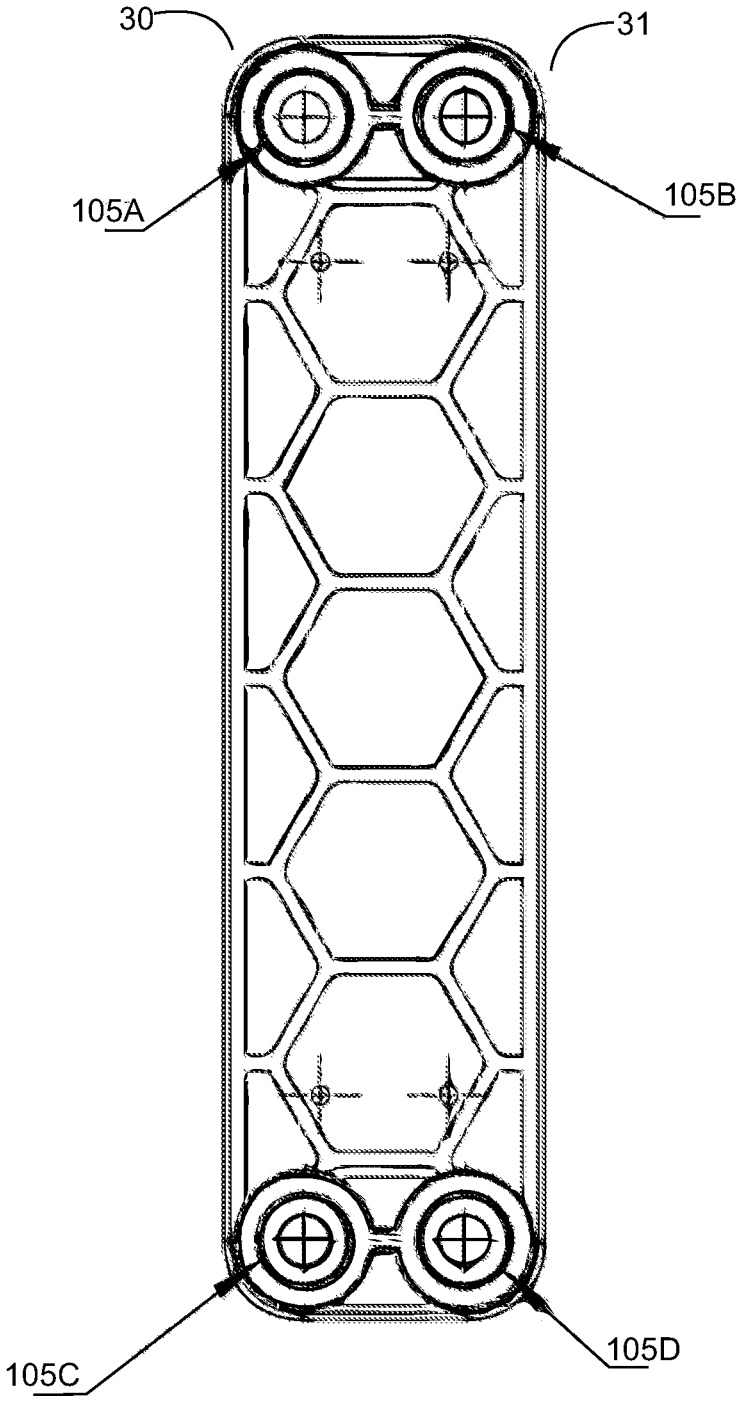
FIG. 23 is a bottom view of the column bracket of the present invention.

As seen in FIGS. 21-23 a column bracket 69 provides a suspension of the road for an elevated road. The column bracket 69 can be stacked for building multiple roadway levels. The column bracket 69 has an upper plane 101 that supports an edge of a block such as a curved section block three, or a straight road section block 62. The upper plane has retaining pillars 102 including a first pillar 102A, a second pillar 102B, a third pillar 102C, and a fourth pillar 102D. The retaining pillars 102 engage with a pair of socket openings on a block 10 formed by the bottom socket opening 24 or the cover socket opening 15. The pair of socket openings are one on the side of the block 10. The retaining pillars 102 align the pair of magnets so that they attract each other for maintaining structural stability of the column bracket 69. The bracket pillars 103 includes a first bracket pillar 103A, second bracket pillar 103B, third bracket pillar 103C, fourth bracket pillar 103D. A pair of bracket pillars protrude from the column bracket 69 left side, and a pair of bracket pillars protrude from the column bracket 69 right side. Similarly, a pair of retaining pillars 102 protrude from the column bracket 69 right side, and a pair of bracket pillars protrude from the column bracket 69 left side. The bracket pillars 103 can protrude into a lower socket 31 of the bracket column 30.

Each bracket pillar 103 has an upper opening 104. The upper opening 104 opposes the lower opening 105. The upper opening includes a first upper opening 104A, a second upper opening 104B, a third upper opening 104C, and a fourth upper opening 104D. The lower opening 105 one a lower socket 31. The lower opening include 105A first lower opening, 105B second lower opening, 105C third lower opening, and 105D fourth lower opening.

Figure 24:
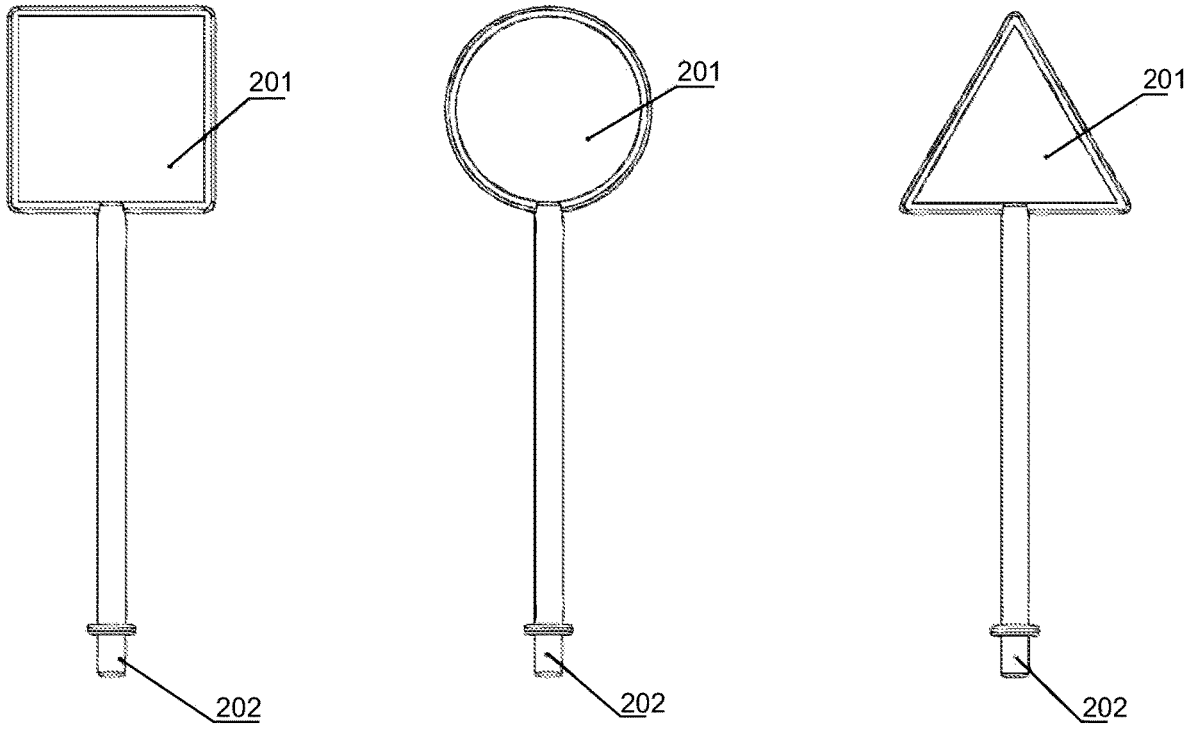
FIG. 24 is a front view of an indicating street sign of the present invention.

As seen in FIG. 24, a variety of different road signs have an upper end 201 and a lower end 202 that can be inserted into the upper openings 104 or the cover socket openings 15.

Figure 26:
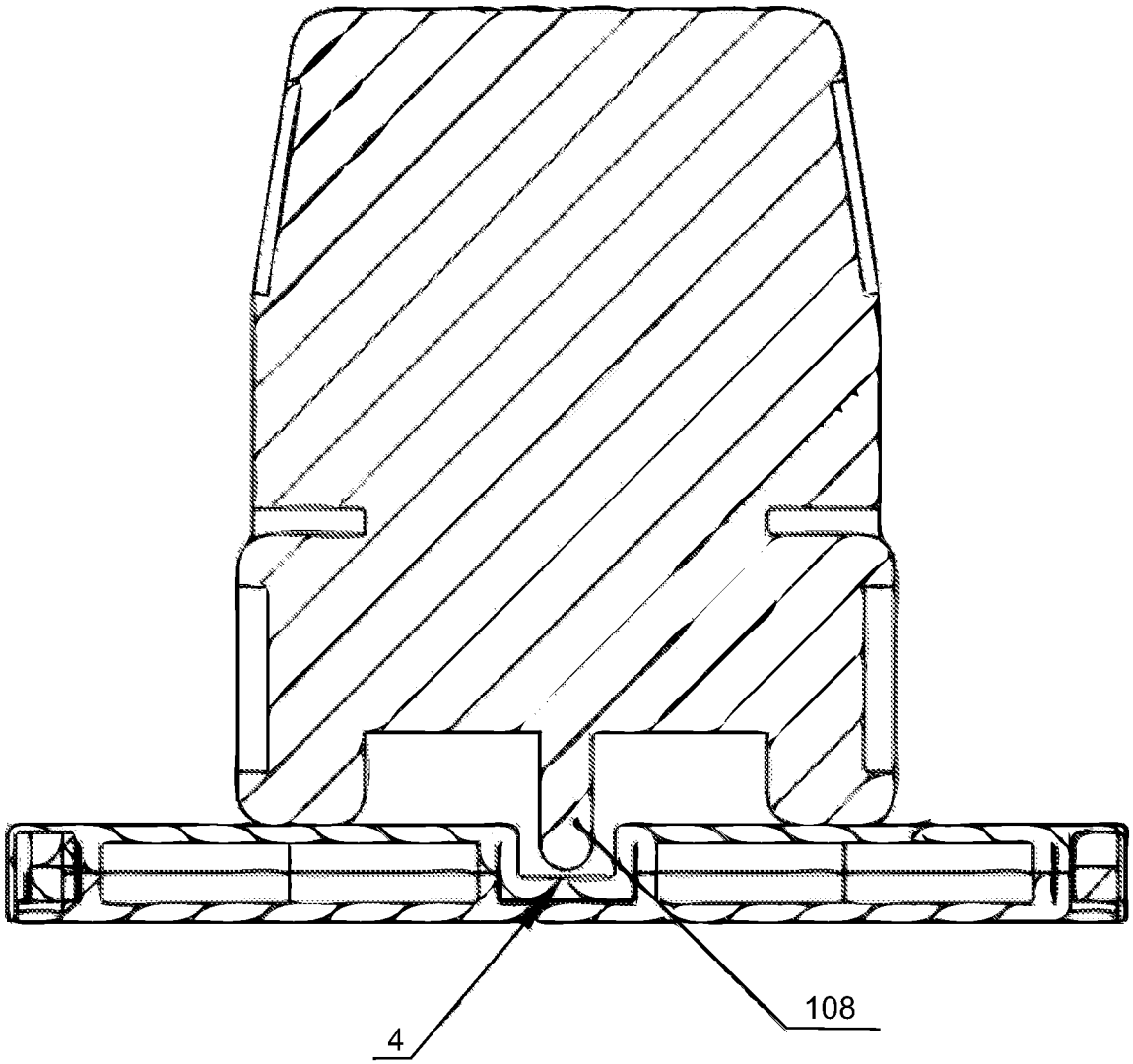
FIG. 26 is a cross sectional view diagram of an interface structure between a bottom of an electric toy vehicle and a building block according to the present invention.

As seen in FIGS. 25-26, a vehicle 106 has a pair of protruding vehicle guides 108 extending downward and engaging to a slot 14 of a track.

Figure 27:
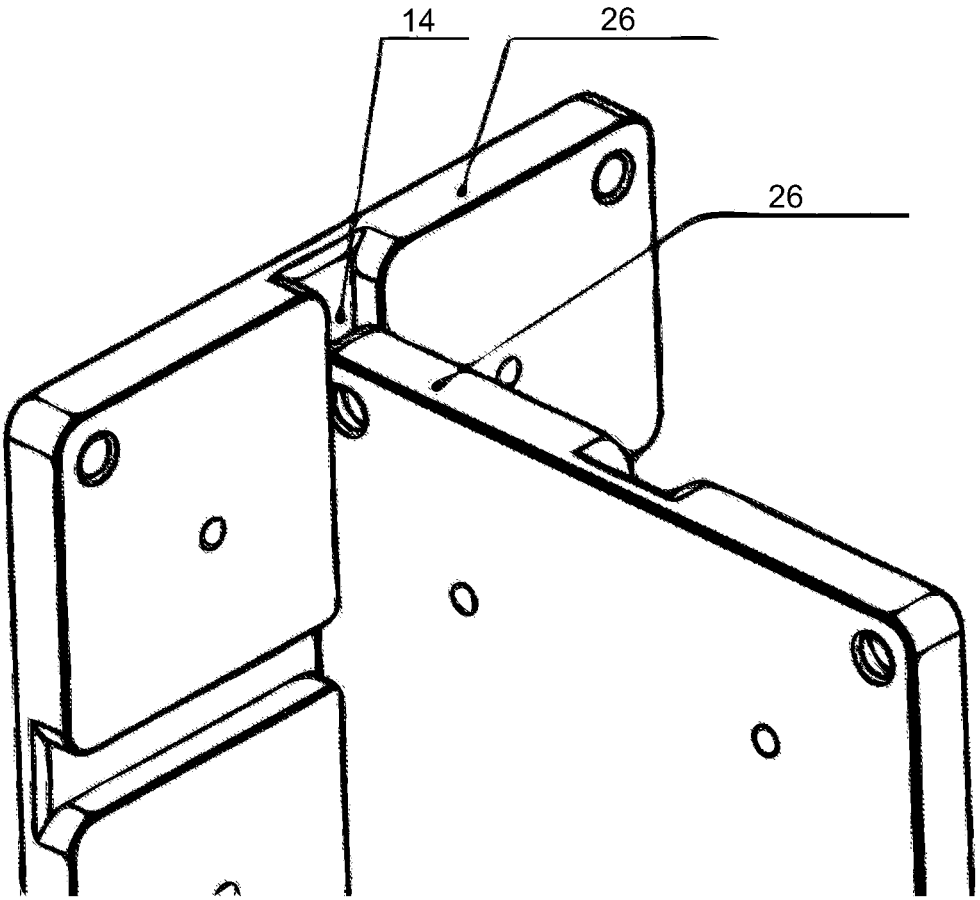
FIG. 27 is a schematic diagram of connection between the building blocks of the present invention by a card into a slot.

As seen in FIG. 27, the slot 14 can receive an edge of a block 10 at a cover sidewall 26 should such insertion be required.

As seen in FIG. 28, the blocks 10 have magnets 13 within them that magnetically align to each other so that the slots 14 are magnetically aligned with each other between blocks. A successive laying of track provides a course for the vehicle 106.

Figure 29:
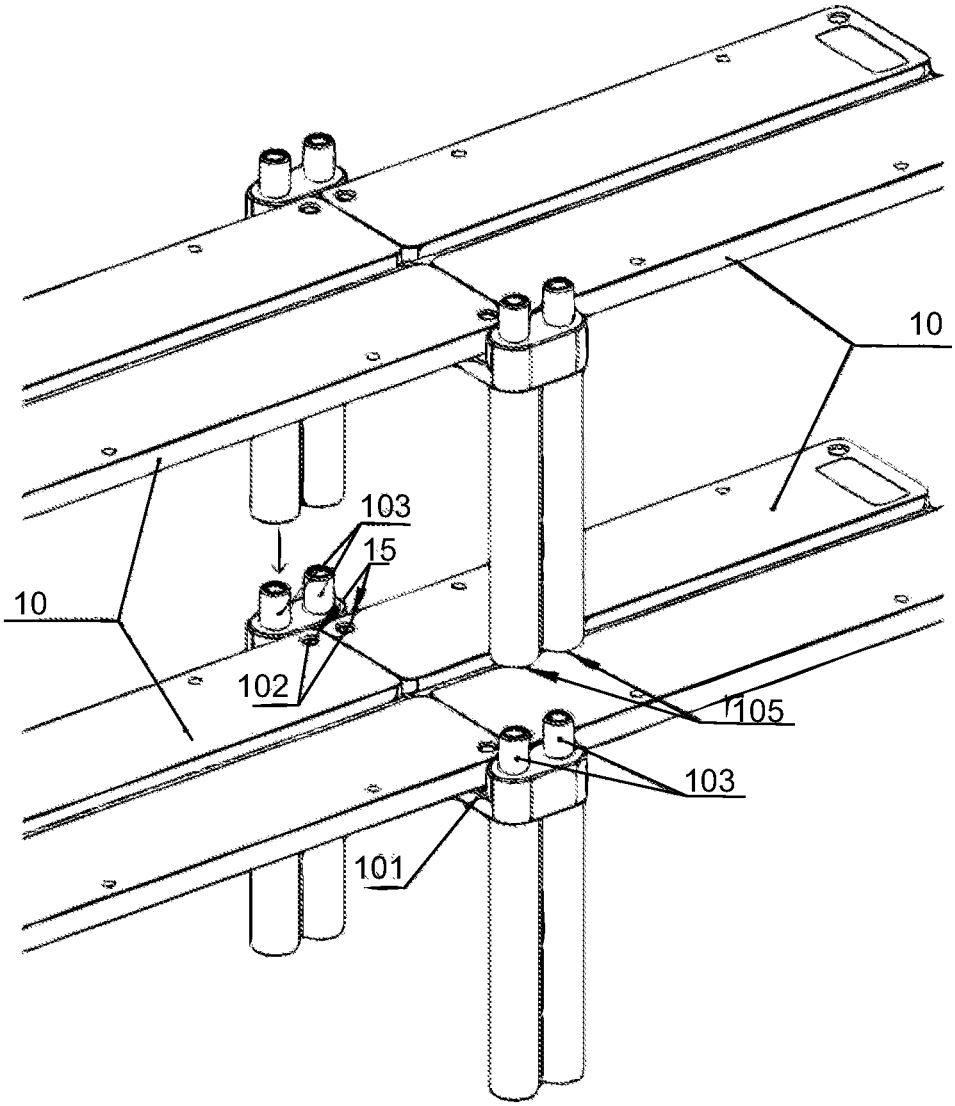
FIG. 29 is a schematic diagram of the connection between the building blocks of the present invention and the building block bracket.

As seen in FIG. 29, the column brackets 69 can stack and provide multiple layer roadways made of blocks 10. The cover socket openings 15 of the blocks 10 engage the retaining pillars 102 of the column brackets 69. The retaining pillars 102 extend from the upper plane 101 of the column bracket 69.

Figure 30:
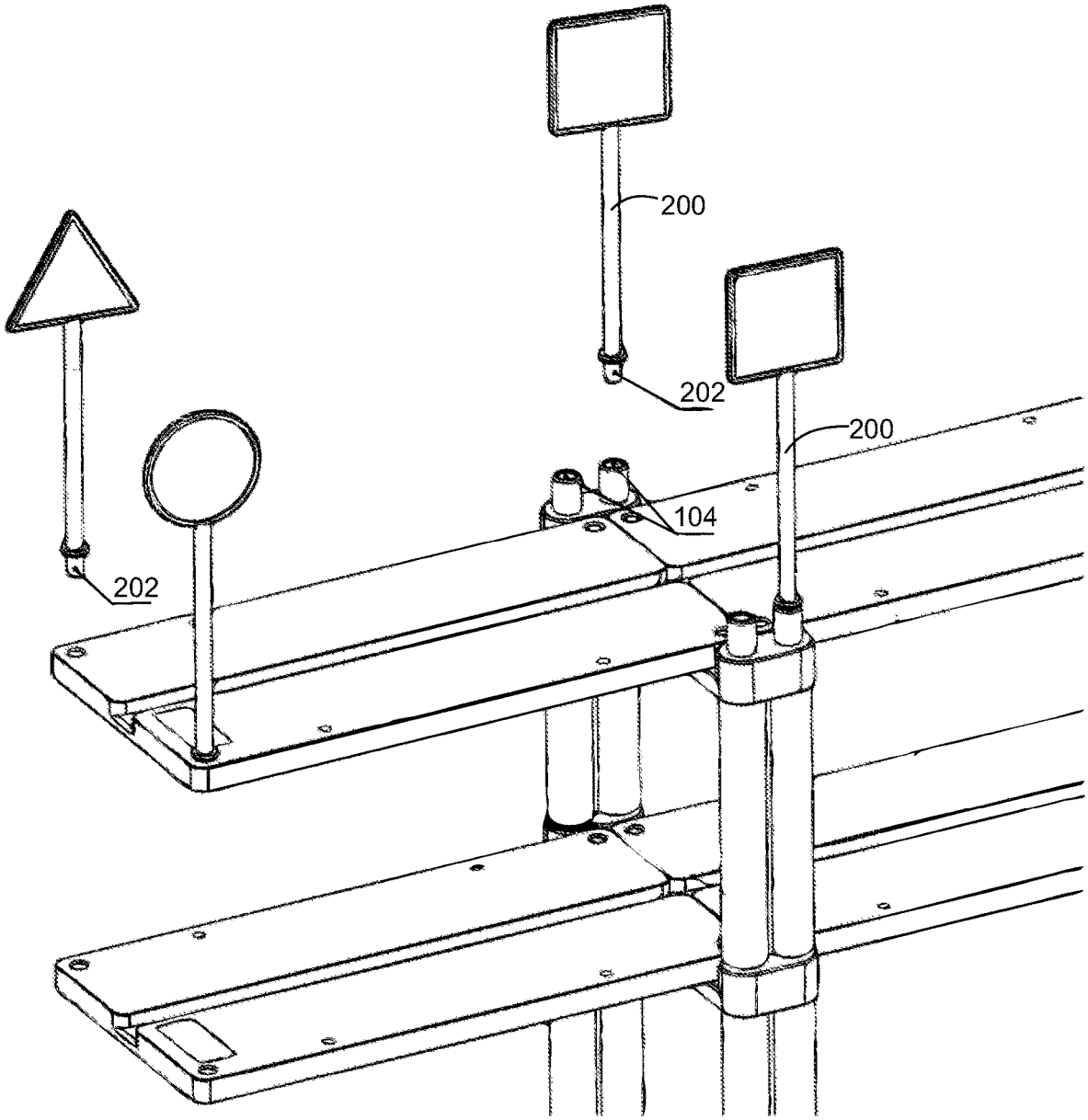
FIG. 30 is a schematic diagram showing the connection between the building block and the building block bracket of the present invention to indicate street signs.

As seen in FIG. 30, the lower end 202 of the sign 200 can be inserted into the upper opening 104 of the column bracket 69.

As seen in FIG. 31, a slot width A of the slot 14 is configured to receive a sidewall height B of a cover sidewall 26.

Figure 32:
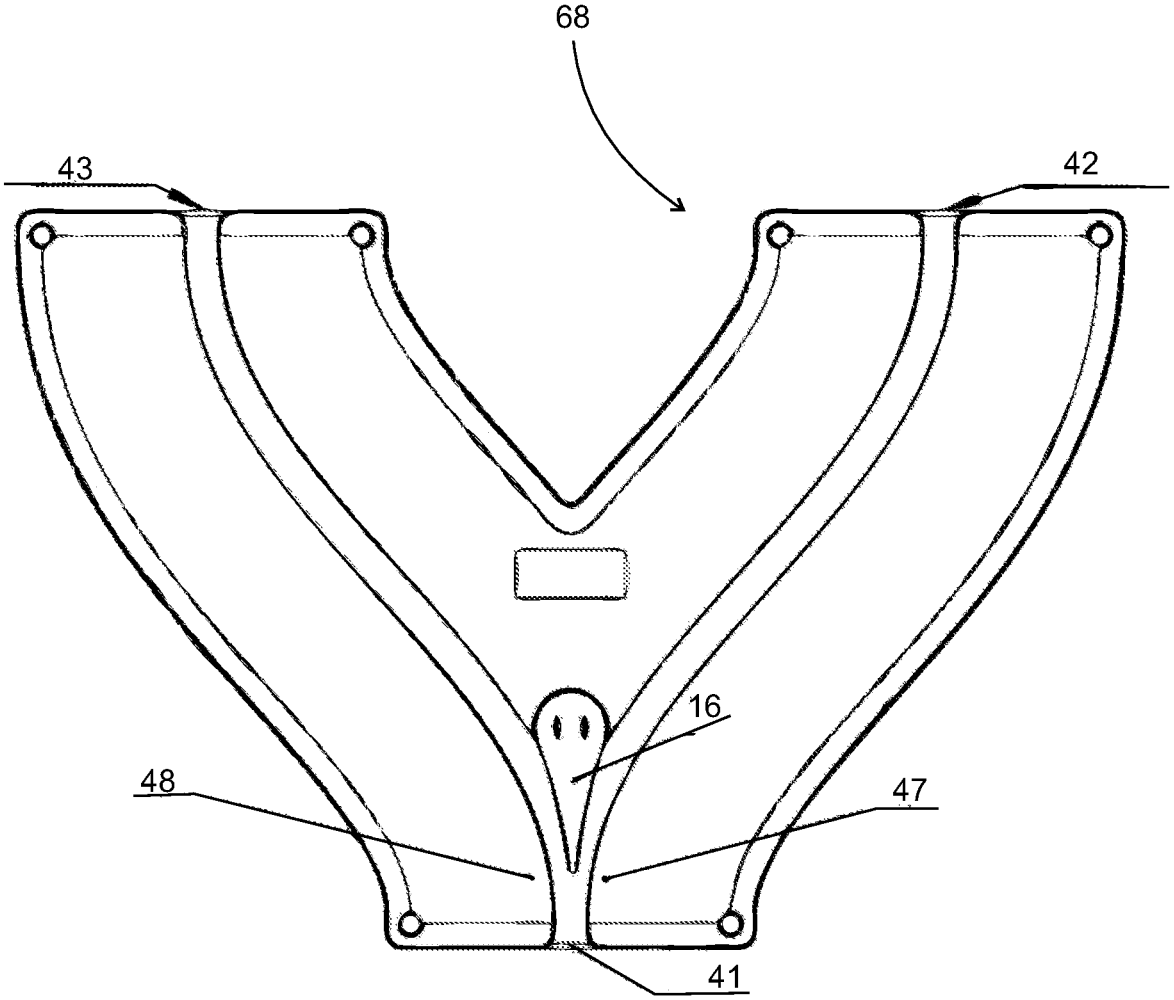
FIG. 32 is a front view of a Y-shaped block nine of the present invention.

As seen in FIG. 32, a Y shaped track 68 has a first entry opening 41 with a right entry slot sidewall 47 and a left entry slot sidewall 48. Similarly, the Y shaped track 68 has a first exit opening 42 and a second exit opening 43. The fork switch 16 is mounted at the entry opening 41.

Figure 33:
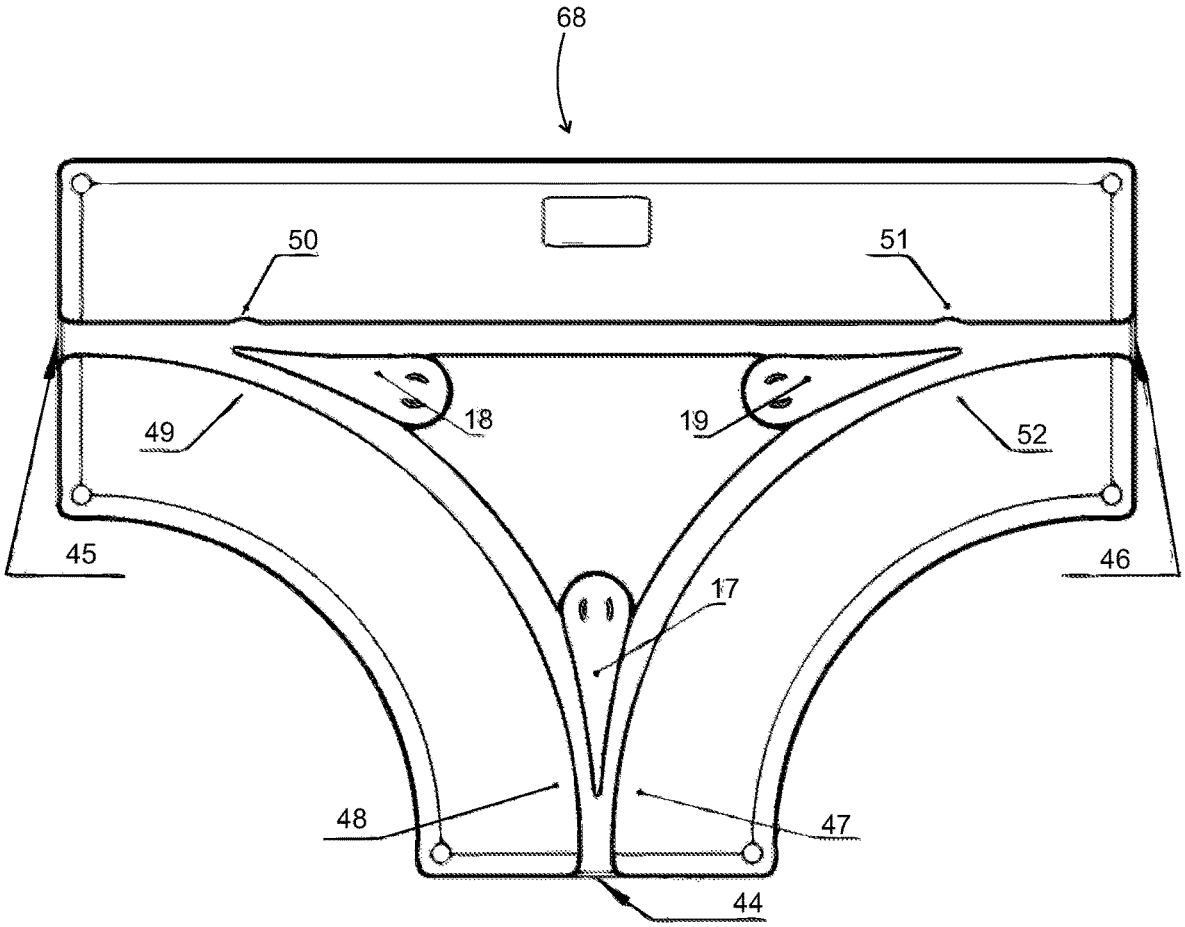
FIG. 33 is a front view of a Y-shaped block of the present invention.

As seen in FIG. 33, a Y shaped track 68 may have the first entry opening 44 with a right entry slot sidewall 47, opposing a left entry slot sidewall 48 with a first switch 17 mounted between the right entry slot sidewall 47 and the left entry slot sidewall 48. The second entry opening 45 and the third entry opening 46 can also be switched so that a second switch 18 is mounted between the second entry opening right slot sidewall 49 and the second entry opening left slot sidewall 50. The third entry opening 46 can be switched with a third switch 19 mounted between a third entry opening first sidewall 51 and a third entry opening second sidewall 52.

Figure 34:
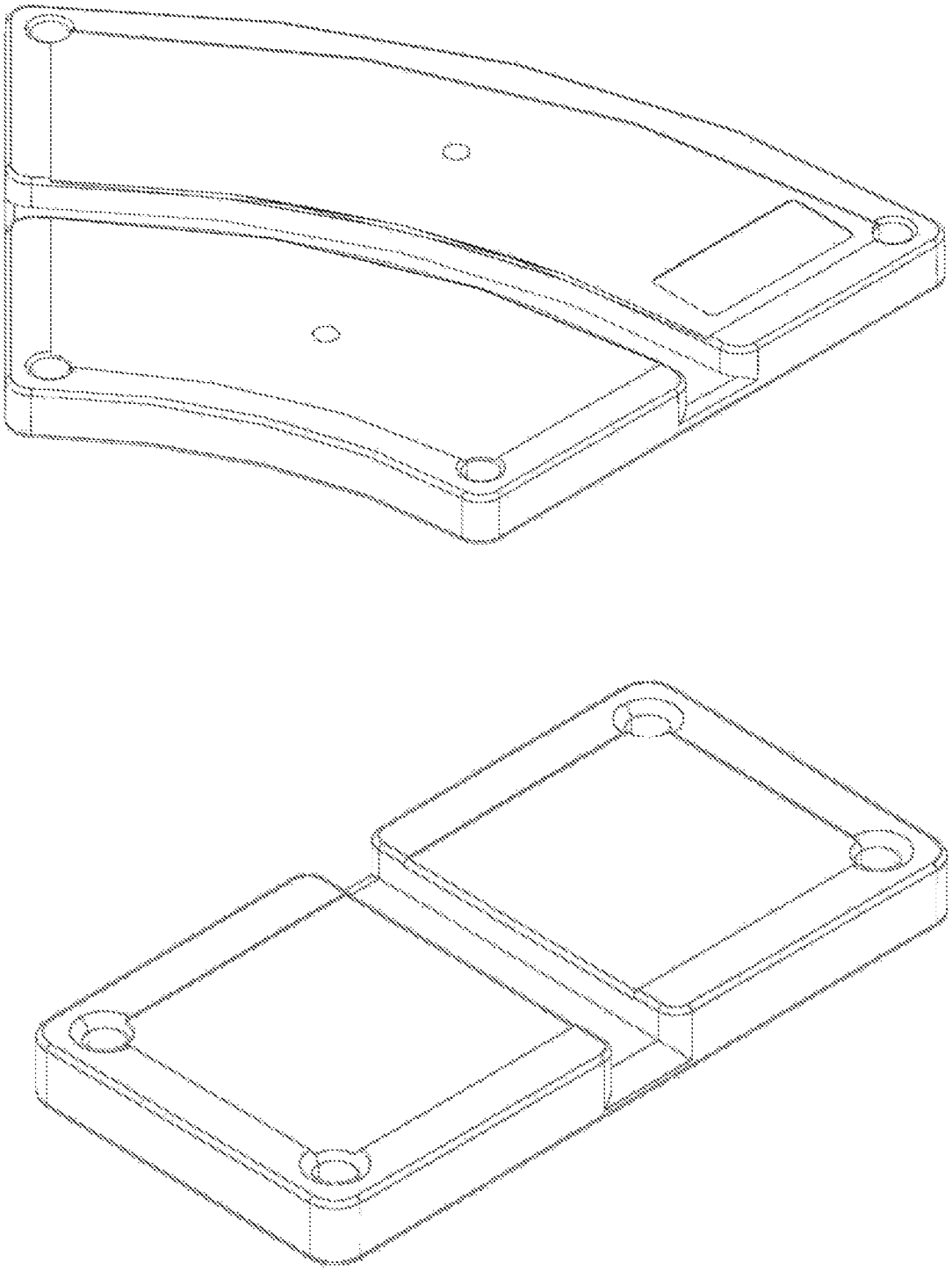
FIG. 34 is a diagram showing additional connector blocks.

As seen in FIG. 34, a variety of miscellaneous connector blocks can be provided for additional leeway in configuring different track route shapes.

The invention claimed is:

1. A magnetic block track and toy vehicle comprising:

track blocks provided as a set of track blocks selected from at least one of the following of the group of: straight road section blocks; curved section blocks; and ramp section blocks, wherein the ramp section blocks connect track blocks between a lower level and a higher level wherein the track blocks are generally planar with a top side and a bottom side, and also having a sidewall with a sidewall height that is less than a length of the track blocks;

a pair of permanent magnets mounted within sidewalls of the track blocks, wherein the pair of permanent magnets are aligned to attract to each other;

a first slot formed on the track blocks starting at slot funnel formed on the sidewall; wherein the first slot is formed between the pair of permanent magnets;

a toy vehicle having a pair of protruding vehicle guides configured to engage the first slot; and a column bracket, wherein the column bracket elevates the track blocks and connects two track blocks on an upper plane, wherein the column bracket has retaining pillars, wherein the retaining pillars engage to socket openings formed at the vertices of the track blocks, wherein the socket openings are formed as through holes, wherein four through holes are formed at each four corners of basic blocks, straight road section blocks, curved section blocks.

2. The magnetic block track and toy vehicle of claim 1, wherein the column bracket has columns with a bracket pillar at an upper end of the column bracket, and a socket at a lower end of the column bracket, wherein multiple levels of column brackets can be stacked with bracket pillars extending into the socket.

3. The magnetic block track and toy vehicle of claim 1, further comprising: a Y shaped track block having a switch, wherein the Y shaped track block has a Y shaped slot, wherein the switch is mounted in the Y shaped slot.

4. The magnetic block track and toy vehicle of claim 1, further comprising: a T shaped track block having three switches, wherein the T shaped track block has a T shaped slot, wherein the three switches are mounted in the T shaped slot.

5. The magnetic block track and toy vehicle of claim 1, wherein basic blocks have a second slot crossing the first slot.

6. The magnetic block track and toy vehicle of claim 1, further including bridge section blocks, wherein the first slot on the bridge section blocks having hump shaped curve.

7. The magnetic block track and toy vehicle of claim 1, wherein the pair of permanent magnets are arranged with an orientation.

8. The magnetic block track and toy vehicle of claim 1, wherein a width of the slot matches a height of the sidewall so that the slot can receive the sidewall in interference fit.

9. The magnetic block track and toy vehicle of claim 1, wherein the track blocks are made of plastic and comprise:

a block bottom with a block bottom frame having a bottom frame rib that extends along a bottom frame flat area, wherein the bottom frame rib forms a magnet retainer notch and bottom socket openings; and a block cover joined to and fitting over the block bottom frame, wherein block cover forms the sidewalls that cooperate with the magnet retainer notch for retaining the magnets.

10. The magnetic block track of claim 1, wherein the bottom frame rib forms magnet walls, namely bottom frame left magnet walls, bottom frame inside magnet walls, and bottom frame right magnet walls, wherein the magnet walls form magnet retainer notches, wherein the magnets are held within the magnet retainer notches.

* * * * *